United States Patent [19]

Sato et al.

[11] Patent Number: 4,824,759

[45] **Date of Patent: * Apr. 25, 1989**

[54] METHOD FOR FORMING AN IMAGE

[75] Inventors: Kozo Sato; Hiroshi Kitaguchi; Masashi Takeuchi; Masaaki Tsukase; Masatoshi Kato, all of Kanagawa, Japan

[73] Assignee: Fuji Photo Film Co., Ltd., Kanagawa, Japan

[ * ] Notice: The portion of the term of this patent subsequent to Jun. 23, 2004 has been disclaimed.

[21] Appl. No.: 827,139

[22] Filed: Feb. 7, 1986

[30] Foreign Application Priority Data

Feb. 7, 1985 [JP] Japan ..... 60-22602

[51] Int. Cl.[4] ..... G03C 1/06; G03C 134

[52] U.S. Cl. ..... 430/203; 430/351; 430/352; 430/353; 430/611; 430/617; 430/619; 430/955; 430/957; 430/960

[58] Field of Search ..... 430/203, 351, 353, 617, 430/619, 611, 960, 955, 957, 352

[56] References Cited

U.S. PATENT DOCUMENTS

| | | | |
|---|---|---|---|
| 4,420,554 | 12/1983 | Ohashi et al. | 430/446 |
| 4,619,884 | 10/1986 | Singer | 430/223 |
| 4,675,277 | 6/1987 | Sato et al. | 430/448 |

*Primary Examiner*—Paul R. Michl
*Assistant Examiner*—Lee C. Wright
*Attorney, Agent, or Firm*—Sughrue, Mion, Zinn, Macpeak, and Seas

[57] ABSTRACT

A method for forming an image, which comprises heating a light-sensitive material in the presence of a compound capable of forming a 2-mercaptobenzazole ring by a ring closing reaction when heated.

In accordance with the method of the present invention, development is stopped at an appropriate time of development whereby an image having a high maximum density and low fog is obtained.

A heat-developable light-sensitive material containing the compound is also disclosed.

16 Claims, No Drawings

METHOD FOR FORMING AN IMAGE

FIELD OF THE INVENTION

The present invention relates to a method for forming an image containing a heating step. In addition, the present invention relates to a heat-developable light-sensitive material containing a precursor of a development inhibitor.

BACKGROUND OF THE INVENTION

Heat-developable photographic light-sensitive materials and methods for forming images using such materials are well known, and are described in detail, for example, in *Shashin Kogaku no Kiso* (*Fundamentals of Photographic Engineering*), Corona Co., Ltd., pp. 553–555 (1979), *Eizo Joho* (*Image Information*) (April 1978), p. 40, and *Neblette's Handbook of Photography and Reprography,* 7th Ed., Van Nostrand Reinhold Company, pp. 32–33 (1977).

For the formation of color images, various techniques have been proposed, including a method in which couplers are used as dye providing compounds (see U.S. Pat. Nos. 3,531,286, 3,761,270 and 4,021,240, Belgian Pat. No. 802,519, and *Research Disclosure* (September, 1975), pp. 31–32), a method in which compound with a nitrogen-containing heterocyclic group introduced in the dye portion are used as dye providing compounds (see *Research Disclosure* (May, 1978), pp. 54–58), a method utilizing the silver dye bleaching process (see *Research Disclosure* (April, 1976), pp. 30–32, ibid. (December, 1976), pp. 14–15, and U.S. Pat. No. 4,235,957), and a method utilizing leuco dyes (see U.S. Pat. Nos. 3,985,565 and 4,022,617), etc.

These methods, however, have their respective technical disadvantages. Their common disadvantages include that preservability of light-sensitive materials are poor and degradation such as increase in fog, etc., with the lapse of time occurs.

In order to overcome the above problems, a method using reductive dye releasing substances which release hydrophilic dyes is described in Japanese Patent Application (OPI) No. 58543/83 (the term "OPI" as used herein refers to a "published unexamined Japanese patent application"). According to the method, the technical disadvantages heretofore known are largely overcome.

However, all of the above described methods for forming images using heat development do not include a technique for stopping development and, thus, problems, for example, increase in fog, degradation of color balance, etc., due to excessive development, are inevitable. As a result, it is difficult to consistently obtain stable images.

SUMMARY OF THE INVENTION

An object of the present invention is to provide a method for forming an image containing a heating step in which development is stopped at an appropriate time of development and the formation of fog due to excessive development is prevented.

Another object of the present invention is to provide a heat-developable light-sensitive material which provides a high maximum density and good color balance.

Other objects of the present invention will become apparent from the following detailed description and examples.

These objects of the present invention can be achieved by a method for forming an image which comprises heating a light-sensitive material in the presence of a compound capable of forming a 2-mercaptobenzazole ring by a ring closing reaction when heated.

DETAILED DESCRIPTION OF THE INVENTION

According to a very preferred embodiment of the method of the present invention, the compound capable of forming a 2-mercaptobenzazole ring by a ring closing reaction when heated is incorporated into a heat-developable light-sensitive material.

Several methods for stopping development when an appropriate state of development is achieved with the passage of time after the beginning of heat development have been proposed. There are, for example, a method in which the pH of the system is reduced at a suitable time after the beginning of development by the generation of acids, a method in which silver development inhibitors are generated, and a method in which substances which are more reductive than dye providing substances are generated.

Among them, most effective method is that in which an inhibitor capable of strongly inhibiting development of silver in a small amount is released at an appropriate time.

As a result of extensive investigations on techniques for releasing such a development inhibitor at an appropriate time, it has been found that a series of compounds which provide 2-mercaptobenzazoles upon a ring closing reaction at a time of heat development according to the present invention are particularly effective.

Various kinds of such compounds are illustrated, and preferred compounds can be represented by formulae (I) to (VIII) described below. These compounds form 2-mercaptobenzazoles upon a ring closing reaction by heating or by heating and an action of silver ions or bases. 2

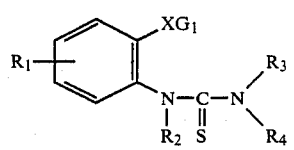

(I)

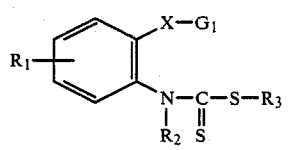

(II)

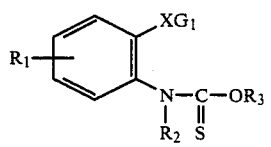

(III)

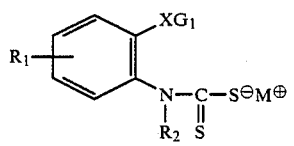

(IV)

-continued (V)

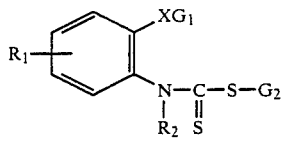

(VI)

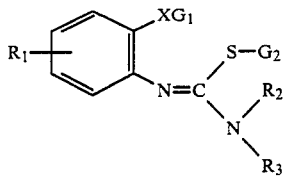

(VII)

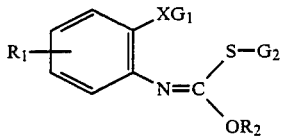

(VIII)

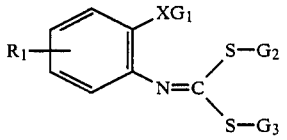

wherein X represents an oxygen atom, a sulfur atom, or a group represented by

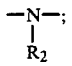

$G_1$, $G_2$, and $G_3$ (which may be the same or different) each represents a hydrogen atom or a protective group capable of being removed upon an action of nucleophilic reagent (e.g., an acyl group, an alkoxycarbonyl group, a sulfonyl group, a phosphoryl group, a p- or o-acyloxybenzyl group, etc.); $R_1$ represents a hydrogen atom, a halogen atom (e.g., a chlorine atom, a bromine atom, an iodine atom, etc.), a substituted or unsubstituted alkyl group having from 1 to 12 carbon atoms (e.g., a methyl group, a butyl group, a dodecyl group, etc.), a substituted or unsubstituted cycloalkyl group having from 5 to 10 carbon atoms (e.g., a cyclopentyl group, a cyclohexyl group, etc.), a substituted or unsubstituted alkenyl group having from 2 to 12 carbon atoms (e.g., a propenyl group, an isopropenyl group, a styryl group, etc.), a substituted or unsubstituted aryl group having from 6 to 14 carbon atoms (e.g., a phenyl group, a tolyl group, etc.), a substituted or unsubstituted aralkyl group having from 7 to 14 carbon atoms (e.g., a benzyl group, a β-phenethyl group, an α-methylbenzyl group, etc.), a substituted or unsubstituted alkoxy group having from 1 to 12 carbon atoms (e.g., a methoxy group, an ethoxy group, a methoxyethoxy group, etc.), a substituted or unsubstituted aryloxy group (e.g., a phenoxy group, a p-chlorophenoxy group, a p-methoxyphenoxy group, etc.), a cyano group, a nitro group, a sulfo group, a carboxy group, an alkylsulfonyl group (e.g., a methylsulfonyl group, an ethylsulfonyl group, a methoxyethylsulfonyl group, etc.), an arylsulfonyl group (e.g., a phenylsulfonyl group, a toluenesulfonyl group, a p-chlorophenylsulfonyl group, etc.), a substituted or unsubstituted sulfamoyl group (e.g., a sulfamoyl group, a dimethylsulfamoyl group, a morpholinosulfonyl group, etc.), a substituted or unsubstituted carbamoyl group (e.g., a carbamoyl group, a dimethylcarbamoyl group, a piperidinocarbonyl group, etc.), a substituted or unsubstituted amino group (e.g., a dimethylamino group, an anilino group, an N-methylanilino group, etc.), an alkylacylamino group (e.g., an acetylamino group, a pivaloylamino group, etc.), an arylacylamino group (e.g., a benzoylamino group, a tolyloylamino group, etc.), an alkylsulfonylamino group (e.g., a methanesulfonylamino group, an octylsulfonylamino group, etc.), or an arylsulfonylamino group (e.g., a phenylsulfonylamino group, a toluenesulfonylamino group, etc.), or two or more of $R_1$ groups are present and in such a case the $R_1$ groups are the same or different, or the $R_1$ groups are connected to form a condensed carbocyclic or heterocyclic ring (e.g., a naphthalene ring, a methylenedioxybenzene ring, a tetrahydronaphthalene ring, an indole ring, a benzofuran ring, etc.) or a part of the carbon atoms in the benzene ring may be replaced with nitrogen atom(s) (e.g., a pyridine ring, a pyrimidine ring, a quinoline ring, etc.); $R_2$, $R_3$ and $R_4$, which may be the same or different, each represents a hydrogen atom, a substituted or unsubstituted alkyl group having from 1 to 8 carbon atoms (e.g., a methyl group, an ethyl group, a methoxyethyl group, etc.), a substituted or unsubstituted aralkyl group having from 7 to 14 carbon atoms (e.g., a benzyl group, a β-phenethyl group, an α-methylbenzyl group, etc.), or a substituted or unsubstituted aryl group having from 6 to 14 carbon atoms (e.g., a phenyl group, a tolyl group, a p-chlorophenyl group, a p-methoxyphenyl group, etc.); and M represents a metallic atom or a primary, secondary, tertiary or quaternary ammonium group.

Specific examples of the compounds capable of forming a 2-mercaptobenzazole ring by a ring closing reaction when subjected to heat development which can be preferably used in the present invention are set forth below, but the present invention should not be construed as being limited to these compounds.

(1)

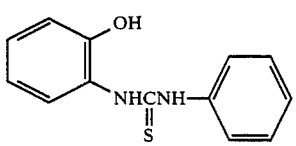

(2)

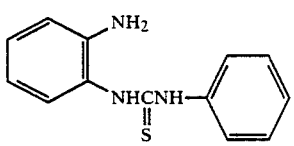

-continued
(3)
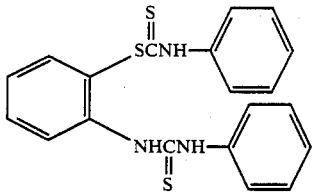
(4)
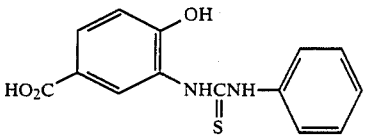
(5)
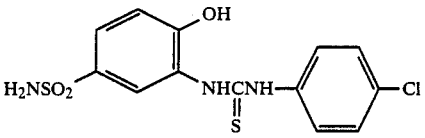
(6)
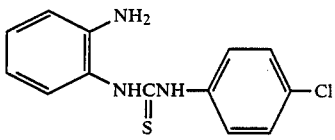
(7)
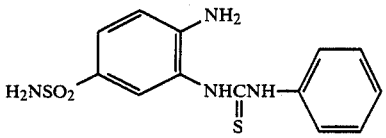
(8)
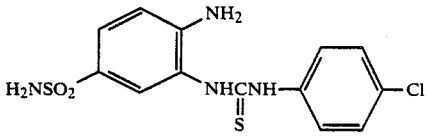
(9)
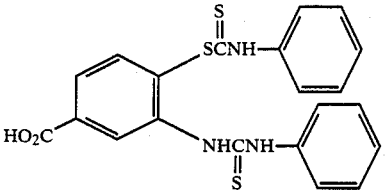
(10)
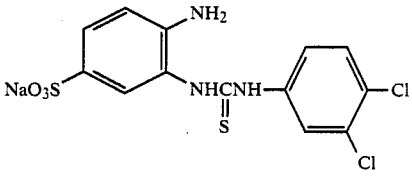
(11)
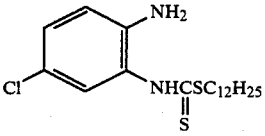
(12)
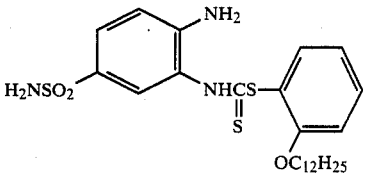
(13)
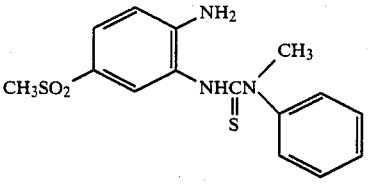
(14)
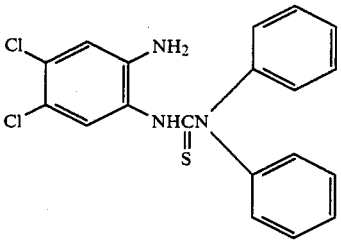
(15)
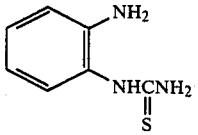
(16)
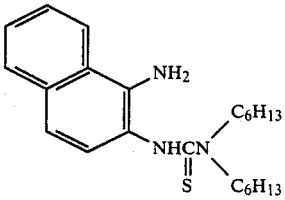
(17)
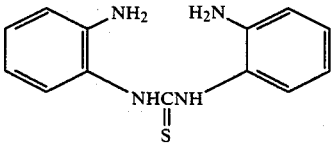
(18)
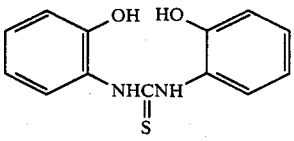

-continued
(19)
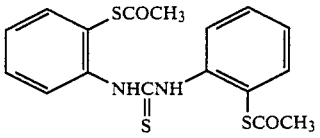
(20)
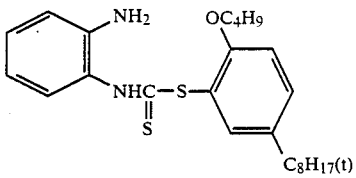
(21)
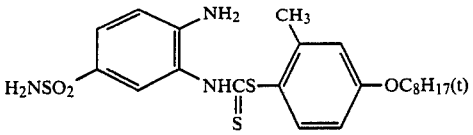
(22)
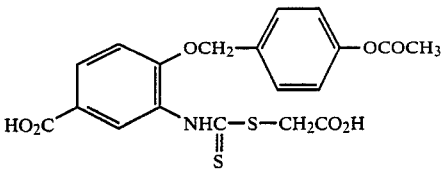
(23)
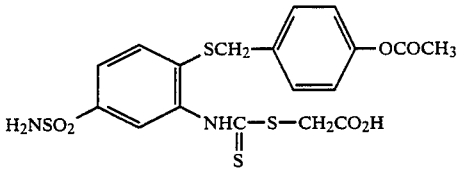
(24)
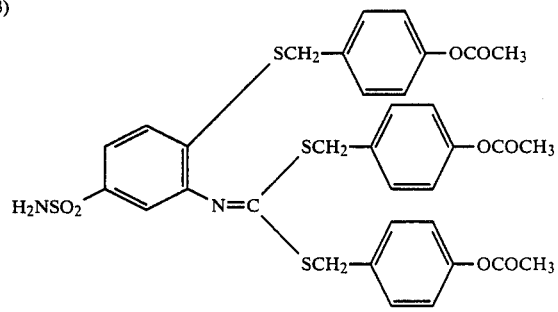
(25)
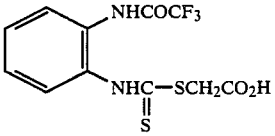
(26)
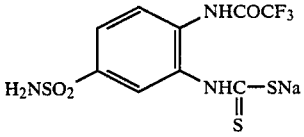
(27)
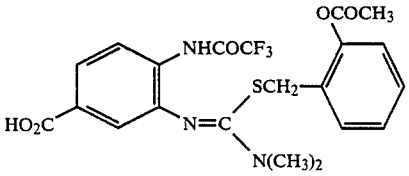
(28)
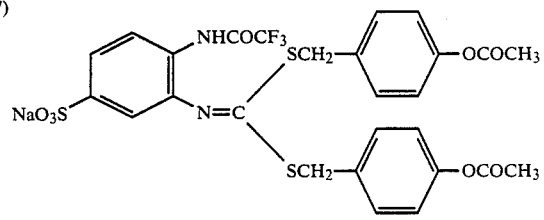
(29)
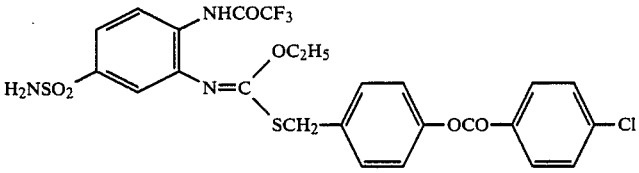
(30)
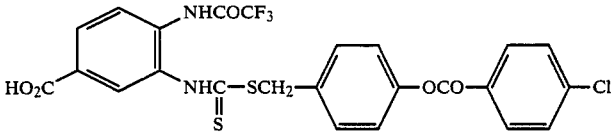
(31)
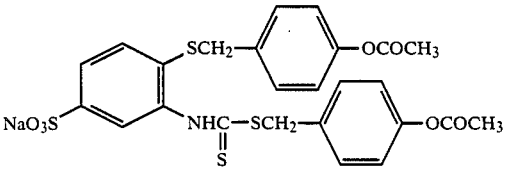
(32)
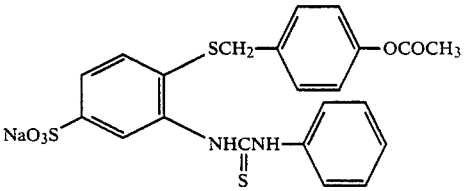

-continued (33)

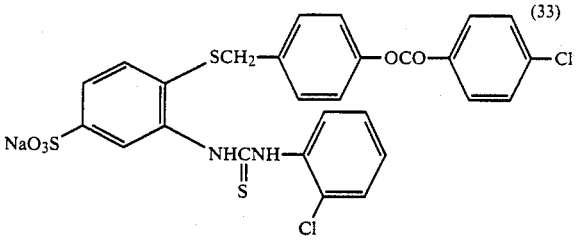

(34)

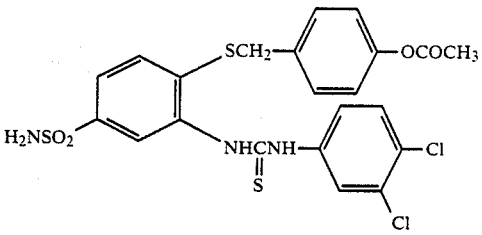

(35)

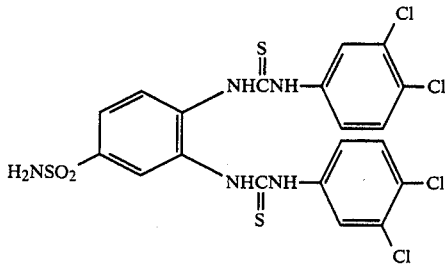

(36)

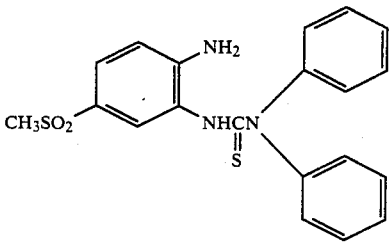

(37)

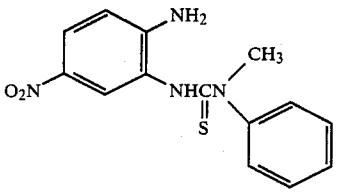

(38)

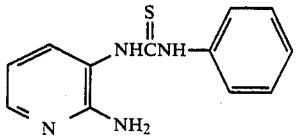

(39)

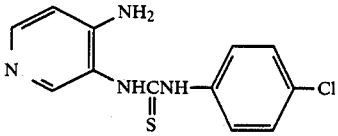

(40)

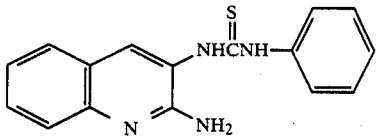

(41)

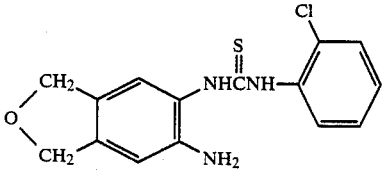

(42)

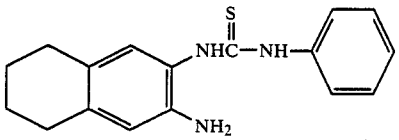

(43)

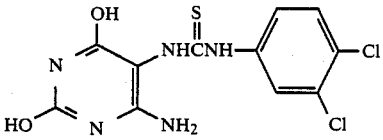

(44)

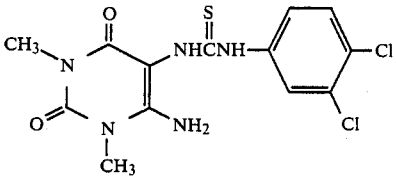

The compound capable of forming a 2-mercaptobenzazole ring by a ring closing reaction when subjected to heat development according to the present invention can be obtained by reacting an o-aminophenol, an o-aminothiophenol or an o-phenylenediamine with a compound which acts as the source of thione, for example, an isothiocyanate, a thiocarbamic chloride, carbon disulfide, etc., and further, if desired, protecting an active site with an appropriate protective group.

Specific examples of synthesizing the compounds according to the present invention are illustrated below.

SYNTHESIS EXAMPLE 1

Synthesis of Compound (2)

To a mixture of 10.8 g of o-phenylenediamine and 50 ml of toluene, 13.5 g of phenyl isothiocyanate was added dropwise at room temperature. After the completion of the dropwise addition, the mixture was stirred at 80° C. for 30 minutes and then allowed to cool. The crystals thus deposited were collected by filtration and the crude crystals were recrystallized from acetonitrile to obtain 13.2 g of the pure product. Melting Point: 142°-144° C. (decomposed).

SYNTHESIS EXAMPLE 2

Synthesis of Compound (7)

3,4-Diaminobenzenesulfonamide was synthesized according to the following synthesis route.

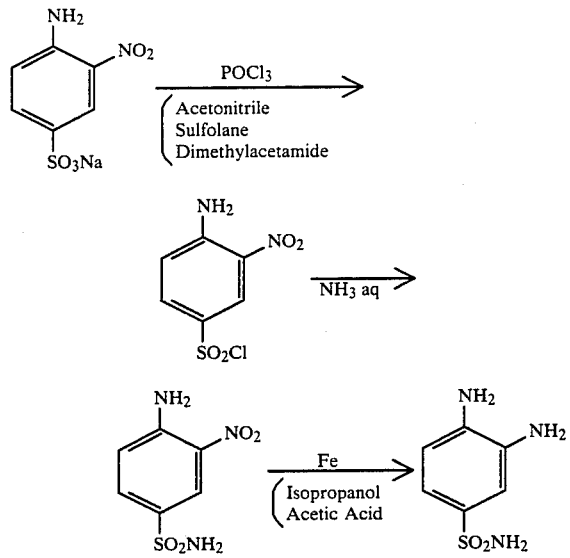

Melting Point: 172° C.

5.61 g of 3,4-diaminobenzenesulfonamide was dissolved in a mixture of 30 ml of acetonitrile and 10 ml of dimethylacetamide and to the solution was added 4.1 g of phenyl isothiocyanate. The mixture was stirred at 50° C. for 30 minutes, then 30 ml of water was added and the mixture was allowed to cool. The pale brown crystals thus deposited were collected by filtration and washed with acetonitrile. The crude crystals were dissolved in dimethylacetamide and to the solution was added twice the volume of water. The crystals thus deposited were collected by filtration to obtain Compound (7).

Yield: 4.4 g. Melting Point: More than 280° C.

In the method of forming an image containing a heating step according to the present invention, the compound capable of forming a 2-mercaptobenzazole ring upon a ring closing reaction is preferably present in a heat-developable light-sensitive material as described above. Other materials in which the compound according to the present invention may be present include a material for fixing diffusible dyes distributed imagewise (i.e., a dye fixing material) and a heat-sensitive material which forms an image by heating imagewise, etc.

Although silver halide is particularly preferred as a light-sensitive substance for the heat-developable light-sensitive material, a diazo compound may also be utilized as the light-sensitive substance.

The added amount of the compound capable of forming a mercaptobenzazole ring to the heat-developable light-sensitive material or the dye fixing material is generally about 0.01 to 50 wt%, preferably about 0.1 to 30 wt%, based on the total weight of coating layers of the light-sensitive material or of the dye fixing material.

In the following, a silver halide heat-developable light-sensitive material to which the method of the invention can be applied is described in greater detail.

The silver halide which can be used in the present invention may include any of silver chloride, silver bromide, silver iodide, silver chlorobromide, silver chloroiodide, silver iodobromide, and silver chloroiodobromide.

A halogen composition in the silver halide grains may be uniform or the silver halide grains may have a multiple structure in which the composition is different between a surface portion and an inner portion (see Japanese Patent Application (OPI) Nos. 154232/82, 108533/83, 48755/84 and 52237/84, U.S. Pat. No. 4,433,048 and European Pat. No. 100,984, etc.).

Also, a tabular grain silver halide emulsion containing grains having a thickness of 0.5 μm or less, a diameter of at least 0.6 μm and an average aspect ratio of 5/1 or more (see U.S. Pat. Nos. 4,414,310 and 4,435,499, and West German Patent Application (OLS) No. 3,241,646A, etc.), and a monodispersed emulsion having a nearly uniform distribution of grain size (see Japanese Patent Application (OPI) Nos. 178234/82, 100846/83, and 14829/83, PCT Application (OPI) No. 83/02338A1, and European Patents 64,412A3 and 83,377A1, etc.) may be used in the present invention.

Two or more kinds of silver halides in which a crystl habit, a halogen composition, a grain size and/or a distribution of grain size, etc., are different from each other may be used in mixture. Further, two or more kinds of monodispersed emulsions having different grain size from each other may be employed in mixture to control gradation.

An average grain size of the silver halide used in the present invention is preferably from 0.001 μm to 10 μm, and more preferably from 0.001 μm to 5 μm.

These silver halide emulsions can be prepared by any of an acid process, a neutral process and an ammonia process. Further, a reaction system of soluble silver salts and soluble halogen salts may be any of a single jet process, a double jet process, and a combination thereof. In addition, a reverse mixing process in which silver halide grains are formed in the presence of an excess of silver ions, or a controlled double jet process in which the pAg in the liquid phase is kept constant is also utilized.

Moreover, for the purpose of increasing the growth of grains, a concentrations used in addition, the amount of the addition, and/or the speed of the addition of silver salts and halogen salts to be added may be raised (see Japanese Patent Application (OPI) Nos. 142329/80 and 158124/80, and U.S. Pat. No. 3,650,757, etc.).

Furthermore, silver halide grains of epitaxial junction type (see Japanese Patent Application (OPI) No. 16124/81, and U.S. Pat. No. 4,094,684, etc.) may be employed.

When only silver halide is employed without using together with an organic silver salt oxidizing agent in the present invention, it is preferred to employ silver chloroiodide, silver iodobromide or silver chloriodobromide the X-ray diffraction pattern of which shows that of silver iodide crystal.

The process for preparing those silver halides having the above-described characteristic is explained by taking the case of silver iodobromide. That is, the silver iodobromide is prepared by first adding a silver nitrate solution to a potassium bromide solution to form silver bromide grains and then adding potassium iodide to the mixture.

In the step of formation of silver halide grains used in the present invention, ammonia, an organic thioether derivative as described in Japanese Patent Publication No. 11386/72, or a compound containing sulfur as described in Japanese patent application (OPI) No. 144319/78, etc., can be used as a solvent for silver halide.

In the formation or physical ripening of silver halide grains, a cadmium salt, a zinc salt, a lead salt, or a thallium salt, etc., may be coexisted. Further, for the purpose of eliminating high intensity reciprocity failure or low intensity reciprocity failure, a water-soluble iridium salt such as iridium(III, IV) chloride, ammonium hexachloroiridiate, etc., or a water-soluble rhodium salt such as rhodium chloride, etc., can be used.

Soluble salts may be removed from the silver halide emulsion after precipitate formation or physical ripening, and a noodle washing process or a flocculation process can be used for this purpose.

While the silver halide emulsion may be employed without being subjected to after-ripening, it is usually chemically sensitized. For the chemical sensitization, a sulfur sensitization method, a reduction sensitization method, and a noble metal sensitization method, etc., which is known in the field of emulsions for conventional type photographic light-sensitive materials, can be applied, alone or in combination. Such a chemical sensitization may be carried out in the presence of a nitrogen-containing heterocyclic compound (see Japanese patent application (OPI) Nos. 126526/83 and 215644/83, etc.).

The silver halide emulsion used in the present invention can be those in which a latent image is formed mainly on the surface of grains, or those in which a latent image is formed mainly in the interior of grains. Further, a direct reversal emulsion in which an internal latent image type emulsion and a nucleating agent are used in a combination may be used. Examples of the internal latent image type emulsions suitable for this purpose are described in U.S. Pat. Nos. 2,592,250 and 3,761,276, Japanese Patent Publication No. 3534/83, and Japanese patent application (OPI) No. 136641/82, etc. Preferred examples of the nucleating agents suitably used in the present invention are described in U.S. Pat. Nos. 3,227,552, 4,245,037, 4,255,511, 4,266,031, and 4,276,364, and West German patent application (OLS) No. 2,635,316, etc.

The coating amount of the light-sensitive silver halide used in the present invention is generally in the range of from 1 mg/m$^2$ to 10 g/m$^2$ calculated as an amount of silver.

In the present invention, an organic metal salt which is relatively stable to light can be used as an oxidizing agent together with the light-sensitive silver halide. In this case, it is necessary that the light-sensitive silver halide and the organic metal salt are present in a contact state or in close proximity. Of these organic metal salts, an organic silver salt is particularly preferably used. In the case of using the organic metal salt together with the silver halide, it is thought that the organic metal oxidizing agent is also involved in the redox system in the presence of a latent image of silver halide as a catalyst, when the heat-developable light-sensitive material is heated to a temperature of above 80° C., and preferably above 100° C.

Examples of organic compounds which can be used for forming the above-described organic silver salt oxidizing agent include an aliphatic or aromatic carboxylic acid, a compound containing a mercapto group or a thiocarbonyl group having an α-hydrogen atom, and a compound containing an imino group, etc.

Typical examples of the silver salts of aliphatic carboxylic acids include a silver salt derived from behenic acid, stearic acid, oleic acid, lauric acid, capric acid, myristic acid, palmitic acid, maleic acid, fumaric acid, tartaric acid, Freund's acid, linolic acid, linoleic acid, oleic acid, adipic acid, sebacic acid, succinic acid, acetic acid, butyric acid, and camphoric acid. Also, a silver salt derived from such an aliphatic carboxylic acid with a halogen atom or a hydrogen group, or an aliphatic carboxylic acid having a thioether group, etc., can be used.

Typical examples of the silver salts of aromatic carboxylic acids and other carboxy group-containing compounds include a silver salt derived from benzoic acid, 3,5-dihydroxybenzoic acid, o-methylbenzoic acid, m-methylbenzoic acid, p-methylbenzoic acid, 2,4-dichlorobenzoic acid, acetamidobenzoic acid, p-phenylbenzoic acid, gallic acid, tannic acid, phthalic acid, terephthalic acid, salicyclic acid, phenylacetic acid, pyromellitic acid, and 3-carboxymethyl-4-methyl-4-thiazoline-2-thione, etc.

Examples of the silver salts of compounds containing a mercapto group or a thiocarbonyl group include a silver salt derived from 3-mercapto-4-phenyl-1,2,4-triazole, 2-mercaptobenzimidazole, 2-mercapto-5-aminothiadiazole, 2-mercaptobenzothiazole, an S-alkyl thioglycolic acid (wherein the alkyl group has from 12 to 22 carbon atoms), a dithiocarboxylic acid such as dithioacetic acid, etc., a thioamide such as thiostearoylamide, etc., 5-carboxy-1-methyl-2-phenyl-4-thiopyridine, and a mercapto compound such as mercaptotriazine, 2-mercaptobenzoxazole, mercaptooxadiazole, or 3-amino-5-benzylthio-1,2,4-triazole, etc., as described in U.S. Pat. No. 4,123,247, etc.

Typical examples of the silver salts of compounds containing an imino group include a silver salt derived from a benzotriazole or a derivative thereof as described in Japanese Patent Publication Nos. 30270/69 and 18416/70, for example, benzotriazole, an alkyl substituted benzotriazole such as methylbenzotriazole, etc., a halogen substituted benzotriazole such as 5-chlorobenzotriazole, etc., a carboimidobenzotriazole such as butylcarboimidobenzotriazole, etc., a nitrobenzotriazole as described in Japanese patent application (OPI) No. 118639/83, a sulfobenzotriazole, a carboxybenzotriazole or a salt thereof, a hydroxybenzotriazole, etc., as described in Japanese patent application (OPI) No. 118638/83, a 1,2,4-triazole or a 1-H-tetrazole as described in U.S. Pat. No. 4,220,709, a carbazole, a saccharin, an imidazole and a derivative thereof, etc.

Moreover, a silver salt as described in *Research Disclosure,* RD No. 17029 (June, 1978), an organic metal salt other than a silver salt such as copper stearate, etc., and a silver salt of a carboxylic acid having an alkynyl group such as phenylpropiolic acid, etc., as described in Japanese patent application No. 221535/83 are also used in the present invention.

The organic silver salt described above can be employed in a range of from 0.01 mol to 10 mols, and preferably from 0.01 mol to 1 mol, per mol of the light-sensitive silver halide. The total coating amount of the light-sensitive silver halide and the organic silver salt is generally from 50 mg/m$^2$ to 10 g/m$^2$.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes, and complex merocyanine dyes are particularly useful. Any conventionally utilized nucleus for cyanine dyes is applicable to these dyes as a basic heterocyclic nucleus. That is, a pyrroline nucleus, an oxzoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing an alicyclic hydrocarbon ring with these nuclei and nuclei formed by condensing an aromatic hydrocarbon ring with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as pyrazolin-5-one nucleus, a thiohydantoin nucleus, a 2-thio-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly for the purpose of supersensitization.

The sensitizing dyes may be present in the emulsion together with dyes which themselves do not give rise to spectrally sensitizing effects but which do exhibit a supersensitizing effect, or materials which do not substantially absorb visible light but which do exhibit a supersensitizing effect. For example, aminostilbene compounds substituted with a nitrogen-containing heterocyclic group (for example, those described in U.S. Pat. Nos. 2,993,390 and 3,635,721), aromatic organic acid-formaldehyde condensates (for example, those described in U.S. Pat. No. 3,743,510), cadmium salts, azaindene compounds, etc., can be present. The combinations as described in U.S. Pat. Nos. 3,615,613, 3,615,641, 3,617,295 and 3,635,721, are particularly useful.

In order to incorporate the sensitizing dye into a silver halide photographic emulsion, it may be directly dispersed in the silver halide emulsion or it may be dissolved in a solvent such as water, methanol, ethanol, acetone, methyl cellosolve, etc., alone or a mixture thereof and then the solution is added to the silver halide emulsion. Further, the sensitizing dye can be dissolved in a solvent which is substantially immiscible with water such as phenoxyethanol, etc., and the solution is then dispersed in water or a hydrophilic colloid and thereafter the dispersion is added to the silver halide emulsion. Moreover, the sensitizing dye can be mixed with an oleophilic compound such as a dye providing compound, etc., and added simultaneously to the silver halide emulsion.

In the case of using a combination of sensitizing dyes, these sensitizing dyes may be separately dissolved or a mixture thereof may be dissolved. Furthermore, these sensitizing dyes may be added separately or simultaneously as a mixture to the silver halide emulsion. They may be added together with other additives to the emulsion.

The time for the addition of the sensitizing dye to the silver halide emulsion may be before, during, or after the chemical ripening, or before, during, or after the formation of silver halide grains as described in U.S. Pat. Nos. 4,183,756 and 4,225,666.

The amount of the sensitizing dye added is generally in the range from about $10^{-8}$ mol to about $10^{=2}$ mol per mol of silver halide.

It is preferred in the present invention that the light-sensitive material contains a compound which forms a mobile dye or releases a mobile dye in correspondence or countercorrespondence to the reaction wherein the light-sensitive silver halide is reduced to silver under a high temperature condition, that is, a dye providing substance.

In the following, the dye providing substance is described in detail.

An example of the dye providing substance which can be used in the present invention is a coupler capable of reacting with a developing agent. A method utilizing such a coupler can form a dye upon a reaction of the coupler with an oxidation product of a developing agent which is formed by an oxidation reduction reaction between the silver salt and the developing agent and is described in many places in the technical literature. Specific examples of the developing agents and the couplers are described in greater detail, for example, in T. H. James, *The Theory of the Photographic Process,* Fourth Edition, pp. 291–334 and pp. 354–361, Macmillan Publ. So., 1977; Shinichi Kikuchi, *Shashin Kagaku* (*Photographic Chemistry*), Fourth Edition, pp. 284–295, Kyoritsu Shuppan Co., etc.

Another example of the dye providing substance is a dye-silver compound in which an organic silver salt is connected to a dye. Specific examples of the dye-silver compounds are described in *Research Disclosure,* RD No. 16966, pp. 54–58 (May, 1978), etc.

Still another example of the dye providing substance is an azo dye used in a heat-developable silver dye bleaching process. Specific examples of the azo dyes and the method for bleaching are described in U.S. Pat. No. 4,235,957, *Research Disclosure,* RD No. 14433, pp. 30–32 (April, 1976), etc.

A further example of the dye providing substance is a leuco dye as described in U.S. Pat. Nos. 3,985,565 and 4,022,617, etc.

A still further example of the dye providing substance which is particularly preferred for the present invention is a compound having a function of imagewise releasing and diffusing a diffusible dye, as utilized in a process described, for example, in European Pat. No. 76,492.

This type of compound can be represented by formula (LI):

$$(\text{Dye}—\text{X})_n—\text{Y} \qquad \text{(LI)}$$

wherein Dye represents a dye moiety or a dye precursor moiety; X represents a simple bond or a connecting group; Y represents a group having a property such that diffusibility of the compound represented by $$(\text{Dye-X})_n\text{Y}$$

can be differentiated in correspondence or counter-correspondence to light-sensitive silver salts having a latent image distributed imagewise, or a group having a property of releasing Dye in correspondence or counter-correspondence to light-sensitive silver salts having a latent imge distributed imagewise, with the diffusibility of Dye released being different from that of the compound represented by $(\text{Dye}—\text{X})_n—\text{Y}$; and n represents 1 or 2 and when n is 2, the two Dye—X groups are the same or different.

Specific examples of the dye providing substance represented by formula (LI) are known and, for example, dye developers in which a hydroquinone type developing agent is connected to a dye component are described in U.S. Pat. Nos. 3,134,764, 3,362,819, 3,597,200, 3,544,545 and 3,482,972, etc. Further, substances capable of releasing diffusible dyes upon an intramolecular nucleophilic displacement reaction are described in Japanese patent application (OPI) No. 63618/76, etc., and substances capable of releasing diffusible dyes upon an intramolecular ring opening and closing reactions of an isoxazolone ring are described in Japanese patent application (OPI) No. 111628/74, etc.

In any of these processes, diffusible dyes are released or diffused in portions where development did not occur. In contrast, in portions where development occurred, there is neither release nor diffusion of dyes.

It is very difficult to obtain images of a high S/N (signal/noise) ratio according to these processes, because development and release or diffusion of dyes occur in parallel. In order to eliminate this drawback, therefore, there has been provided a process in which a dye releasing compound is previously connected to an oxidized form thereof which does not have a dye releasing ability, the oxidized form of the compound is coexistent with a reducing agent or a precursor thereof, and after development, the oxidized form is reduced with the remaining reducing agent which is not oxidized to release a diffusible dye. Specific examples of dye providing substances which can be used in such a process are described in Japanese patent application (OPI) Nos. 110827/78, 130927/79, 164342/81 and 35533/78, etc.

On the other hand, substances capable of releasing diffusible dyes in portions where development occurred are also known. For example, substances capable of releasing diffusible dyes upon a reaction of couplers having diffusible dyes in the releasing groups thereof with oxidation products of developing agents are described in British Pat. No. 1,330,524, Japanese Patent Publication No. 39165/73, U.S. Pat. No. 3,443,940, etc., and substances capable of forming diffusible dyes upon a reaction of couplers having diffusion resistant groups in the releasing groups thereof with oxidation products of developing agents are described in U.S. Pat. No. 3,227,550, etc.

In these processes using color developing agents, there is a severe problem in that images are contaminated with oxidation decomposition products of the developing agents. Therefore, in order to eliminate such a problem, dye releasing compounds which have a reducing property themselves, and thus do not need the use of separate developing agents, have been proposed. Typical examples of such dye releasing compounds are set forth below, together with relevant literature citations. The definitions of the substituents in the generalized formulae set forth below are the same as those described in the relevant literature citations, respectively.

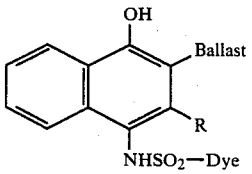

-continued

U.S. Pat. No. 3,928,312

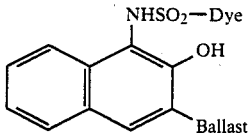

U.S. Pat. No. 4,053,312

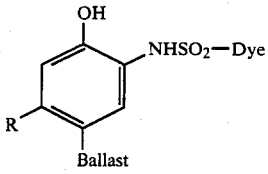

U.S. Pat. No. 4,055,428

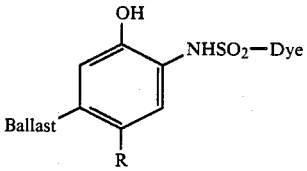

U.S. Pat. No. 4,336,322

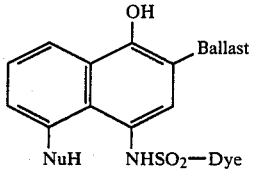

Japanese Patent Application (OPI) No. 65839/84

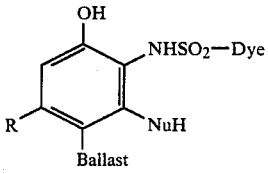

Japanese Patent Application (OPI) No. 69839/84

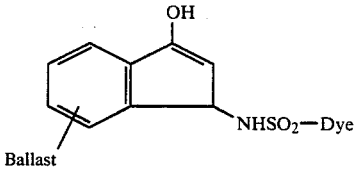

Japanese Patent Application (OPI) No. 3819/78

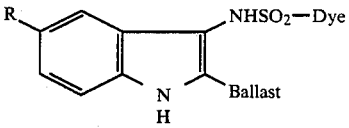

Japanese Patent Application (OPI) No. 104343/76

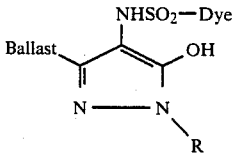

Japanese Patent Application (OPI) No. 104343/76

-continued

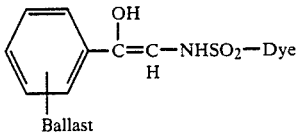

Japanese Patent Application (OPI) No. 104343/76

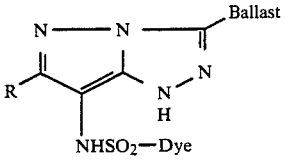

Research Disclosure, RD No. 17465 (Oct., 1978)

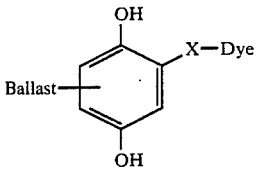

U.S. Pat. No. 3,725,062

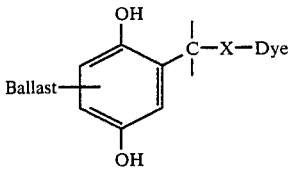

-continued

U.S. Pat. No. 3,728,113

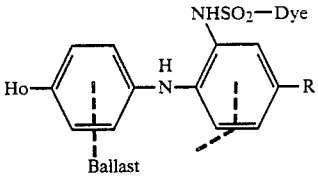

U.S. Pat. No. 3,443,939

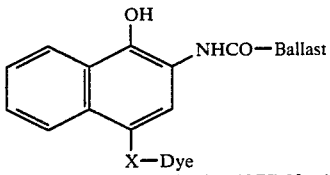

Japanese Patent Application (OPI) No. 116537/83

Any of various dye providing substances described above can be employed in the present invention.

Specific examples of image forming substances used in the present invention are described in the above-mentioned literature citations. Since it is impossible to set forth all of the preferred compounds which can be used in the present invention, a representative group are illustrated as examples. For example, specific examples of the dye providing substances represented by formula (LI) described above are set forth below. However, the present invention should not be construed as being limited thereto.

LI-1

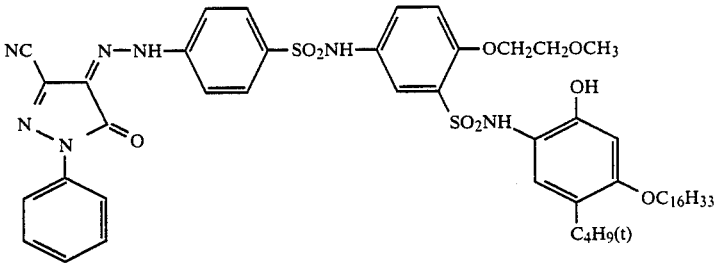

LI-2

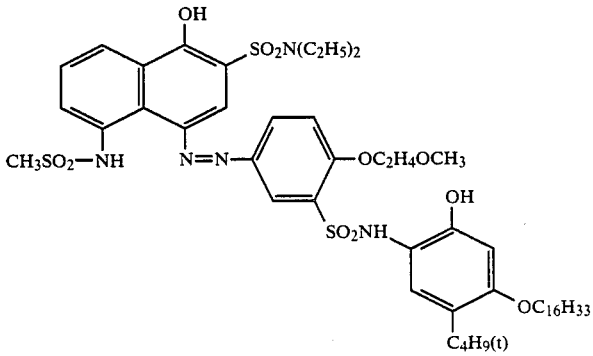

-continued
LI-3
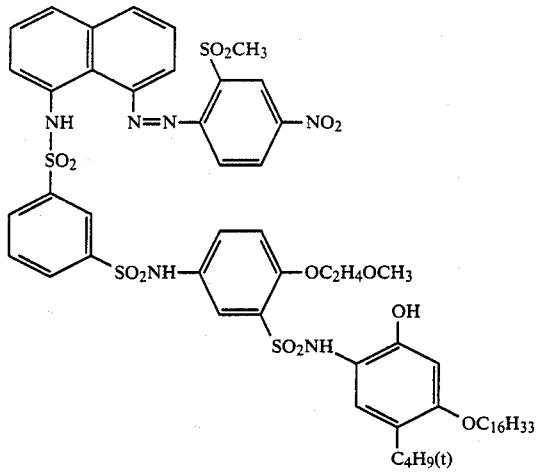
LI-4
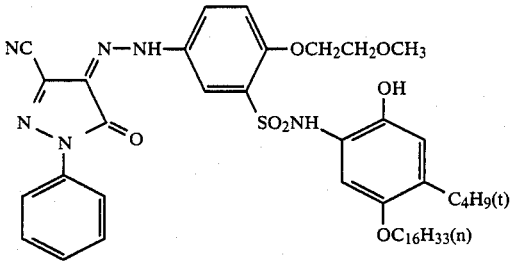
LI-5
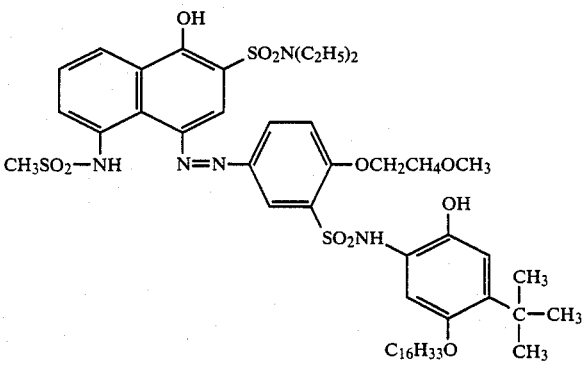
LI-6
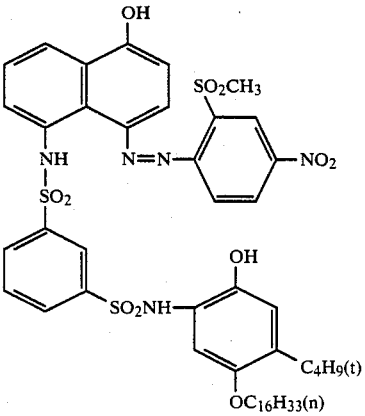

-continued
(LI-7)
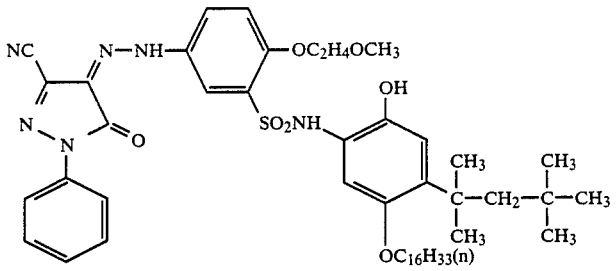
LI-8
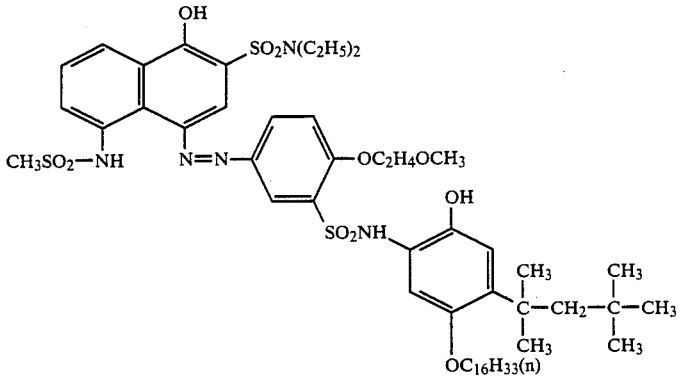
LI-9
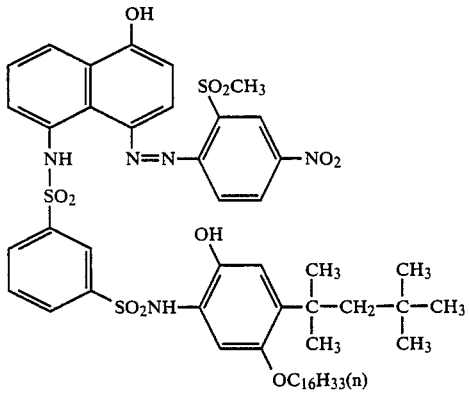
LI-10
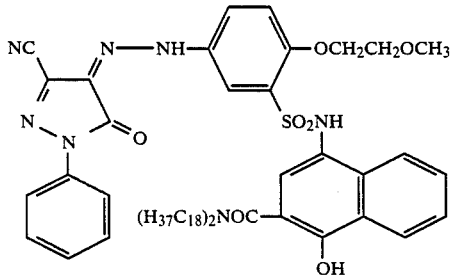

-continued
LI-11
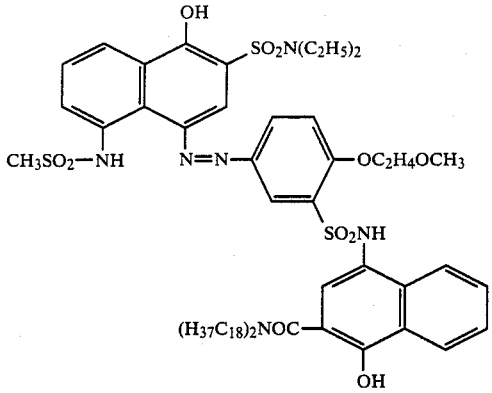
LI-12
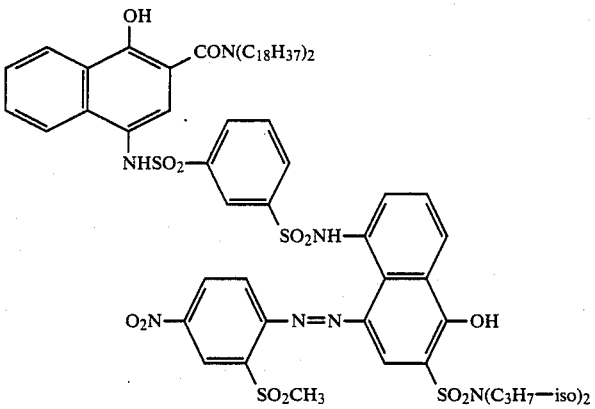
LI-13
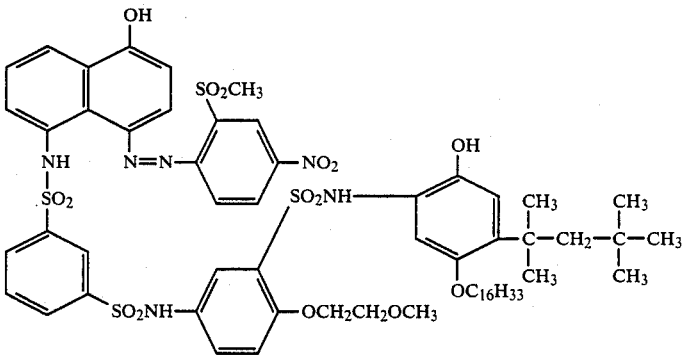
LI-14
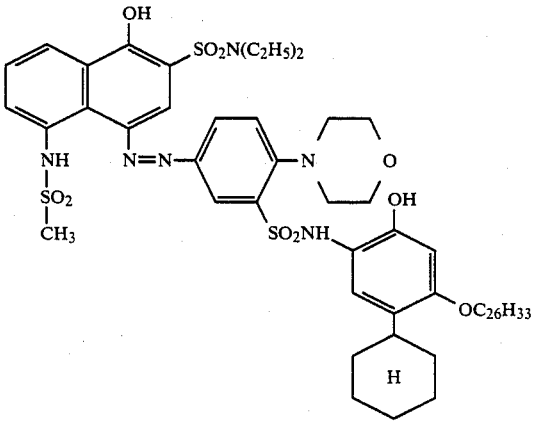

-continued

LI-15

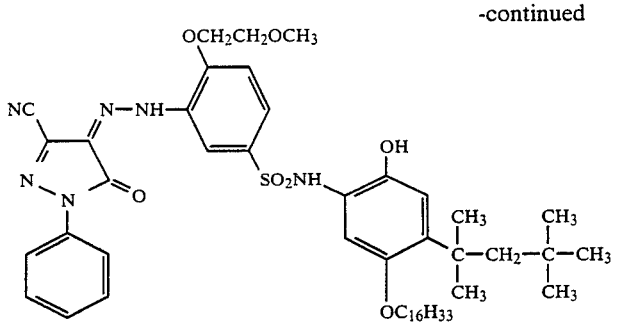

The dye providing substance used in the present invention can be introduced into a layer of the light-sensitive material by known methods such as the method as described in U.S. Pat. No. 2,322,027. In this case, an organic solvent having a high boiling point or an organic solvent having a low boiling point as described below can be used. For example, the dye providing substance is dispersed in a hydrophilic colloid after being dissolved in an organic solvent having a high boiling point, for example, a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkylamide (e.g., diethyl laurylamide, etc.), a fatty acid ester (e.g., dibutoxyethyl succinate, dioctyl azelate, etc.), a trimesic acid ester (e.g., tributyl trimesate, etc.), etc., or an organic solvent having a boiling point of about from 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above-described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance is dispersed in a hydrophilic colloid. For this purpose, the surface active agents as described hereinafter can be used.

An amount of the organic solvent having a high boiling point used in the present invention is 10 g or less, and preferably 5 g or less per 1 g of the dye providing substance used.

In the present invention, it is desirable to incorporate a reducing substance into the light-sensitive material. Examples of the reducing substances include the above-described dye providing substances having a reducing property in addition to substances which are generally known as reducing agents. Further, precursors of reducing agents which do not have a reducing property themselves, but which exhibit a reducing property due to action of nucleophilic reagent or heat in the process of development are also included.

Examples of the reducing agents which can be used in the present invention include an inorganic reducing agent such as sodium sulfite, sodium hydrogen sulfite, etc., a benzenesulfinic acid, a hydroxylamine, a hydrazine, a hydrazide, a boron-amine complex, a hydroquinone, an aminophenol, a catechol, a p-phenylenediamine, a 3-pyrazolidinone, a hydroxytetronic acid, an ascorbic acid, a 4-amino-5-pyrazolone, etc. Reducing agents as described in T. H. James, *The Theory of the Photographic Process*, Fourth Edition, Macmillan Publ. Co., 1977, pp. 291–334 can also be employed. Further, reducing agent precursors as described in Japanese Patent Application (OPI) Nos. 138736/81 and 40245/82, U.S. Pat. No. 4,330,617, etc., may also be employed.

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

In the present invention, an image forming accelerator can be used. The image forming accelerator has a function which accelerates the redox reaction between a silver salt oxidizing agent and a reducing agent, a function which accelerates a reaction of forming a dye, decomposing a dye, or releasing a mobile dye from a dye providing substance, etc., or a function which accelerates transfer of a dye from a layer of the light-sensitive material to a dye fixing layer. From the standpoint of a physical or chemical function, they are classified into a group, for example, a base or base precursor, a nucleophilic compound, an oil, a thermal solvent, a surface active agent, a compound having an interaction with silver or a silver ion, etc. However, such groups of substances usually show complex functions and generally display several of the above-described accelerating effects at the same time.

The image forming accelerators are classified depending on their function and specific examples thereof are set forth below. However, such as classification is only for convenience, and in practice one compound has often multiple functions.

(a) Base

Examples of preferred bases include an inorganic base, for example, a hydroxide, a secondary or tertiary phosphate, a borate, a carbonate, a quinolinate or a metaborate of an alkali metal or an alkaline earth metal, ammonium hydroxide, a hydroxide of a quaternary alkyl ammonium, a hydroxide of other metals, etc., and an organic base, for example, an aliphatic amine (such as a trialkylamine, a hydroxylamine, an aliphatic polyamine, etc.), an aromatic amine (such as an N-alkyl substituted aromatic amine, an N-hydroxyalkyl substituted aromatic amine, a bis-p-(dialkylamino)phenyl methane, etc.), a heterocyclic amine, an amidine, a cyclic amidine, a guanidine, a cyclic guanidine, etc. Among them, those having a pKa of 8 or more are particularly preferred.

(b) Base Precursor

As a base precursor, a substance which releases a base by a reaction when heated, for example, a salt of an organic acid and a base which decomposes by heating with decarboxylation, a compound which releases an amine upon decomposition with an intramolecular nucleophilic displacement reaction, a Lossen rearrangement reaction or a Beckmann rearrangement reaction, etc., are preferably employed. Examples of preferred base precursors include a salt of a trichloroacetic acid as described in British Pat. No. 998,949, etc., a salt of an α-sulfonylacetic acid as described in U.S. Pat. No. 4,060,420, a salt of a propiolic acid as described in Japanese Patent Application (OPI) No. 180537/84, a 2-carboxycarboxamide derivative as described in U.S. Pat. No. 4,088,496, a salt of a thermally decomposable acid using an organic base, an alkali metal or an alkaline earth metal as a base component as described in Japanese Patent Application No. 69597/83 (corresponding to U.S. patent application Ser. No. 601,758 (Apr. 19, 1984)), a hydroxamecarbamate utilizing a Lossen rearrangement as described in Japanese Patent Application (OPI) No. 168440/84, an aldoximecarbamate which forms a nitrile upon heating as described in Japanese Patent Application (OPI) No. 157637/84, etc. Further, base precursors as described in British Pat. No. 998,945, U.S. Pat. No. 3,220,846, Japanese Patent Application (OPI) No. 22625/75, British Pat. No. 2,079,480, etc., are useful.

(c) Nucleophilic Compound

Examples of the nucleophilic compounds include water, a water releasing compound, an amine, an amidine, a guanidine, a hydroxylamine, a hydrazine, a hydrazide, an oxime, a hydroxamic acid, a sulfonamide, an active methylene compound, an alcohol, a thiol, etc. Further, salts or precursors of the above-described compounds may be employed.

(d) Oil

An organic solvent having a high boiling point (so-called plasticizer) which can be used as a solvent for dispersion of a hydrophobic compound is employed.

(e) Thermal Solvent

The thermal solvent is a compound which is solid at an ambient temperature and melts at around a development temperature to act as a solvent. Examples of the thermal solvents include compounds which are selected from a urea, a urethane, an amide, a pyridine, a sulfonamide, a sulfone, a sulfoxide, an ester, a ketone, and an ether and which are solid at 40° C. or below.

(f) Surface Active Agent

Examples of the surface active agents include a pyridinium salt, an ammonium salt, and a phosphonium salt as described in Japanese Patent Application (OPI) No. 57231/84, etc.

(g) Compound Having an Interaction with Silver or a Silver Ion

Examples of the compounds include an imide, a nitrogen-containing heterocyclic compound as described in Japanese Patent Application (OPI) No. 177550/84, a thiol, a thiourea, and a thioether as described in Japanese Patent Application (OPI) No. 111636/84, etc.

The image forming accelerator may be incorporated into either a light-sensitive material, a dye fixing material, or in both of them. Further, it may be incorporated into any of an emulsion layer, an intermediate layer, a protective layer, a dye fixing layer and an adjacent layer thereto. The above description is applicable to an embodiment wherein a light-sensitive layer and a dye fixing layer are provided on the same support.

The image forming accelerators may be employed individually or in a mixture of two or more thereof. In general, a great accelerating effect is obtained when two or more kinds thereof are employed in mixture. Parituclarly, when a base or base precursor is employed together with other kinds of accelerators, a remarkable accelerating effect is revealed.

In the present invention, various kinds of development stopping agents are used in a light-sensitive material or a dye fixing material for the purpose of obtaining constant image properties irrespective of variations in the processing temperature and the processing time when subjected to heat development.

The term "development stopping agent" used herein means a compound which can rapidly neutralize a base or react with a base to decrease concentration of the base in the layer when the development has appropriately proceeded, whereby the development is stopped or a compound which can interact with silver or a silver salt and inhibit the development.

Examples of the development stopping agents include an acid precursor which releases an acid by heating, a development inhibitor precursor which releases a development inhibitor by heating, an electrophilic compound which causes a displacement reaction with a base coexistent by heating, a mercapto compound, a nitrogen-containing heterocyclic compound, etc.

Examples of the acid precursors include an oxime ester as described in Japanese Patent Application Nos. 216928/83 (corresponding to U.S. patent application Ser. No. 672,643 (Nov. 19, 1984)) and 48305/84 (corresponding to U.S. patent application Ser. No. 711,885 (March 14, 1985)), a compound which releases an acid upon a Lossen rearrangement as described in Japanese Patent Application No. 85834/94 (corresponding to U.S. patent application Ser. No. 727,718 (Apr. 26, 1985)), etc.

Examples of the electrophilic compounds which cause a displacement reaction with bases by heating include a compound as described in Japanese Patent Application No. 85836/84 (corresponding to U.S. patent application Ser. No. 727,878 (Apr. 26, 1985)), etc.

The development inhibitor precursor can be incorporated into a binder by dissolving it in a water-soluble organic solvent (e.g., methanol, ethanol, acetone, dimethylformamide, etc.) or a mixture of the organic solvent(s) and water.

The development inhibitor precursor may also be incorporated into a binder in the form of fine particles.

Further, in the present invention, it is possible to use a compound which activates development while simultaneously stabilizing the image. Particularly, it is preferred to use an isothiuronium including 2-hydroxyethylisothiuronium trichloroacetate, etc., as described in U.S. Pat. No. 3,301,678, a bisisothiuronium including 1,8-(3,6-dioxaoctane)bis(isothiuronium trichloroacetate), etc., as described in U.S. Pat. No. 3,669,670, a thiol compound as described in West German Patent Application (OLS) No. 2,162,714, a thiazolium compound such as 2-amino-2-thiazolium trichloroacetate, 2-amino-5-bromoethyl-2-thiazolium trichloroacetate, etc., as described in U.S. Pat. No. 4,012,260, bis(2-amino-2-thiazolium)-methylenebis(sulfonylacetate), 2-amino-2-thiazolium phenylsulfonylacetate, 2-amino-2-thiazolium.2-carboxycarboxamide, etc., as described in U.S. Pat. No. 4,060,420, etc.

Moreover, an azolethioether and a blocked azolinethione compound as described in Belgian Pat. No. 768,071, a 4-aryl-1-carbamyl-2-tetrazoline-5-thione compound as described in U.S. Pat. No. 3,893,859, and a compound as described in U.S. Pat. Nos. 3,839,041, 3,844,788, and 3,877,940 can also be preferably employed.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer compound, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

A suitable coating amount of binder according to the present invention is 20 g or less, preferably 10 g or less, and more preferably 7 g or less, per $m^2$.

A suitable amount of the organic solvent having a high boiling point which is dispersed in a binder together with a hydrophobic compound such as a dye providing substance with respect to the binder is 1 ml or less, preferably 0.5 ml or less, and more preferably 0.3 ml or less, per g of the binder.

In the photographic light-sensitive material and the dye fixing material according to the present invention, the photographic emulsion layer and other binder layers may contain an inorganic or organic hardener. It is possible to use a chromium salt (e.g., chromium alum, chromium acetate, etc.), an aldehyde (e.g., formaldehyde, glyoxal, glutaraldehyde, etc.), an N-methylol compound (e.g., dimethylolurea, methyloldimethylhydantoin, etc.), a dioxane derivative (e.g., 2,3-dihydroxydioxane, etc.), an active vinyl compound (e.g., 1,3,5-triacryloyl-hexahydro-s-triazine, 1,3-vinylsulfonyl-2-propanol, 1,2-bis(vinylsulfonylacetamide)ethane, etc.), an active halogen compound (e.g., 2,4-dichloro-6-hydroxy-s-triazine, etc.), a mucohalogenic acid (e.g., mucochloric acid, mucophenoxychloric acid, etc.), etc., which are used individually or as a combination thereof.

A support used in the light-sensitive material and the dye fixing material employed, if desired, according to the present invention is that which can endure at the processing temperature. As an ordinary support, not only may glass, paper, metal, or analogs thereof be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. A polyester as described in U.S. Pat. Nos. 3,634,089 and 3,725,070 is preferably used.

In the case of using dye providing substances which release imagewise mobile dyes in the present invention, the transfer of dyes from the light-sensitive layer to the dye fixing layer can be carried out using a dye transfer assistant.

The dye transfer assistant suitably used in a process wherein it is supplied from the outside includes water and an alkaline aqueous solution-containing sodium hydroxide, potassium hydroxide, or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the dye transfer assistant.

When the dye transfer assistant is incorporated into the light-sensitive material or the dye fixing material, it is not necessary to supply the transfer assistant from the outside. In this case, the above-described dye transfer assistant may be incorporated into the material in the form of water of crystallization or microcapsules or as a precursor which releases a solvent at a high temperature.

A more preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the intermediate layer, the protective layer, and the dye fixing layer, it is preferred to incorporate it into the dye fixing layer and/or an adjacent layer thereto.

Examples of the hydrophilic thermal solvents include a urea, a pyridine, an amide, a sulfonamide, an imide, an alcohol, an oxime, and other heterocyclic compounds.

In order to increase sharpness of images, a filter dye or an absorbing substance as described in Japanese Patent Publication No. 3692/73, U.S. Pat. Nos. 3,253,921, 2,527,583, 2,956,879, etc., can be incorporated into the light-sensitive material used in the present invention. It is preferred for such a dye to lose its color upon heating. For example, dyes as described in U.S. Pat. Nos. 3,769,019, 3,745,009, 3,615,432, etc., are preferably employed.

The light-sensitive material used in the present invention may contain, if desired, various additives which are known for use in heat-developable light-sensitive materials, and layers other than the light-sensitive layer, for example, an antistatic layer, an electrically conductive layer, a protective layer, an intermediate layer, an antihalation layer, a stripping layer, etc. Various additives which can be used include those as described in *Research Disclosure*, RD No. 17029 (June, 1978), for example, a plasticizer, a sharpness improving dye, an antihalation dye, a sensitizing dye, a matting agent, a surface active agent, a fluorescent whitening agent, a color fading preventing agent, etc.

The photographic element according to the present invention is composed of a light-sensitive element which forms or releases a dye upon development by heating, and, if desired, a dye fixing element for fixing a dye. Particularly in a system wherein images are formed by diffusion transfer of dyes, both the light-sensitive element and the dye fixing element are essential. Typical photographic elements employed in such a system are divided broadly into two embodiments, viz., an embodiment in which the light-sensitive element and the dye fixing element are provided on two supports separately, and an embodiment in which the both elements are provided on the same support.

The embodiment in which the light-sensitive element and the dye fixing element are formed on different supports is classified into two types. Specifically, one is a peel-apart type, and the other is a non-peel-apart type.

In the case of the peel-apart type, a coated surface of the light-sensitive element and a coated surface of the dye fixing element are superposed on each other after image exposure or heat development, and then after formation of transferred images the light-sensitive element is rapidly peeled apart from the dye fixing element. A support of the dye fixing element is selected from an opaque support and a transparent support depending on the face of whether the final image is a reflective type or a transmitting type. Further, a white reflective layer may be provided on the support, if desired.

In the case of the latter non-peel-apart type, it is necessary that a white reflective layer is present between a light-sensitive layer of the light-sensitive element and a dye fixing layer of the dye fixing element. The white reflective layer can be provided in either the light-sensitive element or the dye fixing element. In this case, a support of the dye fixing element is requested to be a transparent support.

One representative example of the embodiment in which the light-sensitive element and the dye fixing element are provided on the same support is a type in which the light-sensitive element is not necessary to peel apart from the image receiving element after the formation of transferred images. In such a case, on a transparent or opaque support a light-sensitive layer, a dye fixing layer and a white reflective layer are superposed. Examples of preferred embodiments of layer structure include transparent or opaque support/light-sensitive layer/white reflective layer/dye fixing layer structure, or a transparent support/dye fixing layer/-white reflective layer/light-sensitive layer structure.

Another typical example of the embodiment in which the light-sensitive element and the dye fixing element are provided on the same support is a type in which a part or all of the light-sensitive element is separated from the dye fixing element and a stripping layer is provided on an appropriate position of the element as described, for example, in Japanese Patent Application (OPI) No. 67840/81, Canadian Pat. No. 674,082, U.S. Pat. No. 3,730,718, etc.

The light-sensitive element or the dye fixing element may form a structure having an electrically conductive heat generating layer suitable to use as heating means for the purpose of heat development or diffusion transfer of dyes.

In order to reproduce a large range of color in a chromaticity diagram using three elementary colors, i.e., yellow, magenta and cyan, it is necessary that the light-sensitive element used in the present invention contains at least three silver halide emulsion layers each having sensitivity in a different spectral region.

Typical examples of the combination of at least three silver halide emulsion layer each having sensitivity in a different spectral region include a combination of a blue-sensitive emulsion layer, a green-sensitive emulsion layer and a red-sensitive emulsion layer; a combination of a green-sensitive emulsion layer, a red-sensitive emulsion layer and an infrared light-sensitive emulsion layer; a combination of a blue-sensitive emulsion layer, a green-sensitive emulsion layer and an infrared light-sensitive emulsion layer; a combination of a blue-sensitive emulsion layer, a red-sensitive emulsion layer and an infrared light-sensitive emulsion layer, etc. The reference to an infrared light-sensitive emulsion layer herein means an emulsion layer having sensitivity to light in a region of 700 nm or more, and particularly in a region of 740 nm or more.

The light-sensitive material used in the present invention may also include two or more light-sensitive emulsion layers which are sensitive to light of the same spectral region but have different sensitivities, if desired.

It is necessary that each of the above-described emulsion layers and/or light-insensitive hydrophilic colloid layers adjacent to the emulsion layers contain at least one kind of a dye providing substance capable of releasing or forming a yellow hydrophilic dye, a dye providing substance capable of releasing or forming a magenta hydrophilic dye, and a dye providing substance capable of releasing or forming a cyan hydrophilic dye, respectively. In other words, in each of the emulsion layers and/or light-insensitive hydrophilic colloid layers adjacent to the emulsion layers, dye providing substances capable of releasing or forming hydrophilic dyes having different hues should be incorporated, respectively. If desired, two or more kinds of dye providing substances having the same hue may be used in mixture. In the case of using dye providing substances which are colored originally, it is particularly advantageous that the dye providing substances are incorporated into layers other than these emulsion layers.

The light-sensitive material used in the present invention may contain, if desired, a subsidiary layer, for example, a protective layer, an intermediate layer, an antistatic layer, an anti-curling layer, a stripping layer, a matting layer, etc., in addition to the above-described layers.

Particularly, the protective layer (PC) usually contains an organic or inorganic matting agent for the purpose of preventing adhesion. Further, the protective layer may contain a mordant, an ultraviolet light-absorbing agent, etc. The protective layer and the intermediate layer may be composed of two or more layers, respectively.

Moreover, the intermediate layer may contain a reducing agent for preventing color mixing, an ultraviolet light-absorbing agent, a white pigment such as $TiO_2$, etc. A white pigment may also be incorporated into the emulsion layer in addition to the intermediate layer, for the purpose of increasing sensitivity.

In order to impart the spectral sensitivity as described above to the silver halide emulsion, the silver halide emulsion may be spectrally sensitized using known sensitizing dyes so as to obtain the desired spectral sensitivity.

The dye fixing element which can be used in the present invention comprises at least one layer containing a mordant. When the dye fixing layer is positioned on the surface of the dye fixing element, a protective layer can be further provided in the element, if desired.

Further, the dye transfer assistant may be incorporated into the dye fixing layer, if desired. The element may comprise a water absorbing layer or a layer containing the dye transfer assistant in order to control the dye transfer assistant. These layers may be provided adjacent to the dye fixing layer or provided through an intermediate layer.

The dye fixing layer used in the present invention may be composed of two or more layers containing mordants which have mordanting powers different from each other, if desired.

The dye fixing element used in the present invention may contain, if desired, a subsidiary layer, for example, a stripping layer, a matting layer, an anti-curling layer, etc., in addition to the above-described layers.

Into one or more of the layers described above, a base and/or base precursor for the purpose of accelerating dye transfer, a hydrophilic thermal solvent, a color fading preventing agent for preventing fading of dyes, an ultraviolet light absorbing agent, a dispersed vinyl compound for the purpose of increasing dimensional stability, a fluorescent whitening agent, etc., may be incorporated.

The binder which can be used in the above-described layers is preferably a hydrophilic binder. The typical hydrophilic binder is a transparent or translucent hydrophilic colloid, examples of which include a natural substance, for example, protein such as gelatin, a gelatin derivative, polyvinyl alcohol, a cellulose derivative, etc., a polysaccharide such as starch, gum arabic, etc., and a synthetic polymer compound, for example, dextrin/pullulan, a water-soluble polyvinyl compound such as polyvinyl alcohol, polyvinyl pyrrolidone, acrylamide polymer, etc. Among them, gelatin and polyvinyl alcohol are particularly preferred.

The dye fixing element may include a reflective layer containing a white pigment such as titanium oxide, etc., a neutralizing layer, a neutralization timing layer, etc., in addition to the above-described layer depending on the purposes. These layers may be provided not only in the dye fixing element but also in the light-sensitive element. The compositions of these reflective layer, neutralizing layer and neutralization timing layer are described, for example, in U.S. Pat. Nos. 2,983,606, 3,362,819, 3,362,821 and 3,415,644, Canadian Pat. No. 928,559, etc.

It is advantageous that the dye fixing element according to the present invention contains a transfer assistant described below. The transfer assistant may be incorporated into the above-described dye fixing layer or a different layer.

In the present invention, a transparent or opaque heat generating element used in the case of adopting current heating as a means for development can be prepared utilizing heretofore known techniques with respect to a resistance heat generator.

Resistance heat generator techniques include a method utilizing a thin layer of an inorganic material exhibiting a property of semiconductor and a method utilizing a thin layer of an organic material composed of electrically conductive fine particles dispersed in a binder. The materials which can be employed in the former method include silicon carbide, molybdenum silicide, lanthanum chromate, barium titanate ceramics used as a PTC thermistor, tin oxide, zinc oxide, etc. These materials can be used to prepare a transparent or opaque thin layer in a known manner. With the latter method, electrically conductive fine particles such as metallic fine particles, carbon black, graphite, etc., are dispersed in a binder such as rubber, a synthetic polymer, gelatin, etc., to prepare a resistor having a desired temperature characteristic. The resistor may be either directly brought into contact with the light-sensitive element or separated by a support or an intermediate layer, etc.

The image receiving layer used in the present invention includes a dye fixing layer which can be used in heat-developable color light-sensitive materials. A mordant to be used can be selected appropriately from mordants conventionally used. Among them, polymeric mordants are particularly preferred. The polymer mordants include polymers containing tertiary amino groups, polymers containing nitrogen-containing heterocyclic moieties, and polymers containing quaternary cationic groups thereof, etc.

Specific examples of polymers containing vinyl monomer units having a tertiary amino group are described in Japanese Patent Application Nos. 169012/83 and 166135/83, etc. Specific examples of polymers containing vinyl monomer units having a tertiary imidazole group are described in Japanese Patent Application No. 226497/83 (corresponding to U.S. Patent Application Ser. No. 676,987 (Nov. 30, 1984)), Japanese Patent Application (OPI) No. 122941/85 and U.S. Pat. Nos. 4,282,305, 4,115,124, 3,148,061, etc.

Specific examples of preferred polymers containing vinyl monomer units having a quaternary imidazolium salt are described in British Pat. Nos. 2,056,101, 1,093,041, and 1,594,961, U.S. Pat. Nos. 4,124,386, 4,115,124, 4,273,853, and 4,450,224, Japanese Patent Application (OPI) No. 28225/73, etc.

Specific examples of other preferred polymers containing vinyl monomer units having a quaternary ammonium salt are described in U.S. Pat. Nos. 3,709,690, 3,898,088 and 3,958,995, Japanese Patent Application (OPI) Nos. 57836/85, 60643/85, 122940/85 and 122942/85 and Japanese Patent Application No. 91620/84 (corresponding to U.S. patent application Ser. No. 731,695 (May 8, 1985)), etc.

As light sources of imagewise exposure in order to record images on the heat-developable light-sensitive material, radiant rays including visible light can be utilized. Generally, light sources used for conventional color prints can be used, examples of which include tungsten lamps, mercury lamps, halogen lamps such as iodine lamps, xenon lamps, laser light sources, CRT light sources, fluorescent tubes and light emitting diodes (LED), etc.

The heating temperature in the step of heat development is in the range described hereinbefore, and it is preferably 140° C. or higher, particularly 150° C. or higher. A heating temperature in the step of transferring can be in a range from the temperature in the step of heat development to room temperature. It is preferred to use a temperature up to about 10° C. lower than the temperature in the step of heat development.

As the heating means for development step and transferring step, a simple heat plate, an iron, a heat roller, a heat generator utilizing carbon or titanium white, etc., can be employed.

The dye transfer assistant (e.g., water) can accelerate the transfer of images by being furnished between the light-sensitive layer of heat-developable light sensitive material and the dye fixing layer of dye fixing material. Also, the dye transfer assistant may be previously applied to either the light-sensitive layer, the dye fixing layer, or both of them, and then the both layers may be superposed.

As the heating means for the transferring step, heating by passing between heat plates or bringing into contact with a heated plate (e.g., as described in Japanese Patent Application (OPI) No. 62635/75), heating by bringing into contact with a rotating heat drum or heat roller (e.g., as described in Japanese Patent Publication No. 10791/68), heating by passing through hot air (e.g., as described in Japanese Patent Application (OPI) No. 32737/78), heating by passing through an inert liquid maintaining at a constant temperature, heating by passing along a heat generator using a roller, belt, or guiding material (e.g., as described in Japanese Patent Publication No. 2546/69), etc., can be used. Further, a layer of an electrically conductive material such as graphite, carbon black, metal, etc., is superposed on the dye fixing material and the dye fixing material is directly heated by turning on an electric current.

The heating temperature in the step of transferring can be in the range from the temperature in the step of heat development to room temperature. Particularly, it is preferred to use a temperature in the range of from 60° C. to a temperature 10° C. lower than the temperature in the step of heat development.

According to the present invention, light-sensitive material which can reduce the formation of fog due to excessive development and provide images of high density and good color balance are obtained.

The present invention will be explained in greater detail with reference to the following examples, but the present invention should not be construed as being limited thereto.

Unless otherwise indicated, all parts, percents, ratios and the like are by weight.

EXAMPLE 1

A method for preparing a silver iodobromide emulsion is described in the following.

40 g of gelatin and 26 g of potassium bromide (KBr) were dissolved in 3,000 ml of water and the solution was maintained at 50° C. with stirring. A solution of 34 g of silver nitrate dissolved in 200 ml of water was added to the above-prepared solution over 10 minutes. Then, a solution of 3.3 g of potassium iodide (KI) dissolved in 100 ml of water was added over 2 minutes. The thus-prepared silver iodobromide emulsion was adjusted in pH, precipitated, and freed of excess salts. It was then adjusted to a pH of 6.0, whereby 400 g of a silver iodobromide emulsion was obtained.

A method for preparing a silver benzotriazole emulsion is described in the following.

28 g of gelatin and 13.2 g of benzotriazole were dissolved in 3,000 ml of water and the solution was maintained at 40° C. with stirring. A solution of 17 g of silver nitrate dissolved in 100 ml of water was added to the above prepared solution over 2 minutes. The thus-prepared silver benzotriazole emulsion was adjusted in pH, precipitated, and freed of excess salts. It was then adjusted to a pH of 6.0, whereby 400 g of a silver benzotriazole emulsion was obtained.

A method for preparing a gelatin dispersion of a dye providing substance (hereinafter having the same meaning as the references an image forming substance described above) is described in the following.

A mixture of 5 g of the Yellow Dye Providing Substance (LI-4) described above, 0.5 g of succinic acid 2-ethylhexyl ester sulfonic acid sodium salt as a surface active agent, 10 g of triisononyl phosphate, 0.3 g of o-dodecyloxythiophenol and 30 ml of ethyl acetate was dissolved by heating at about 60° C. to prepare a uniform solution. This solution was mixed with 100 g of a 10% aqueous solution of lime-processed gelatin with stirring and the mixture was dispersed by means of a homogenizer at 10,000 rpm for 10 minutes. The dispersion thus obtained was designated as a dispersion of yellow dye providing substance.

A dispersion of magenta dye providing substance was prepared in the same manner as described above, except using Magenta Dye Providing Substance (LI-8) as described above. Further, a dispersion of cyan dye providing substance was prepared in the same manner as described above, except using Cyan Dye Providing Substance (LI-16) as described below.

Cyan Dye Providing Substance (LI-16):

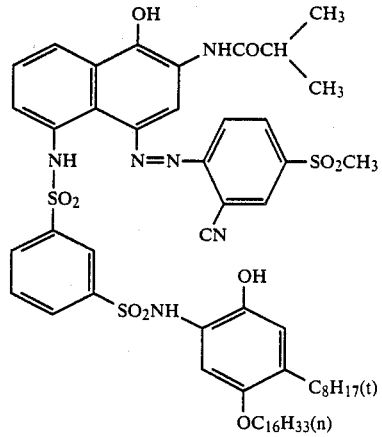

A method for preparing a gelatin dispersion of the compound according to the present invention is described in the following.

3 g of Compound (2) according to the present invention was added to 100 g of a 1% aqueous solution of gelatin and the mixture was ground in a mill using 100 g of glass beads having an average diameter of about 0.6 mm for 10 minutes. By removing the glass beads by filtration, a gelatin dispersion of the compound according to the present invention was obtained.

A color light-sensitive material having the multilayer structure shown in Table 1 below was prepared using the above-described components. This material was designated Light-Sensitive Material A. In Table 1 below, numerals in parentheses indicate coating amounts.

TABLE 1

| Light-Sensitive Material A | |
|---|---|
| Sixth Layer | Gelatin (1,000 mg/m$^2$),<br>Base precursor*3 (220 mg/m$^2$),<br>Compound (2) according to the present invention (10 mg/m$^2$) |
| Fifth Layer (blue-sensitive emulsion layer) | Silver iodobromide emulsion (iodide: 10 mol %, silver coverage: 400 mg/m$^2$),<br>Compound*4 (180 mg/m$^2$),<br>Base precursor*3 (520 mg/m$^2$),<br>Compound (2) according to the present invention (5 mg/m$^2$),<br>Yellow Dye Providing Substance (LI-4) (400 mg/m$^2$),<br>Gelatin (1,000 mg/m$^2$),<br>Solvent having a high boiling point*1 (800 mg/m$^2$),<br>Surface active agent*2 (100 mg/m$^2$),<br>Compound*5 (24 mg/m$^2$) |
| Fourth Layer (intermediate layer) | Gelatin (1,200 mg/m$^2$),<br>Base precursor*3 (220 mg/m$^2$),<br>Compound (2) according to the present |

TABLE 1-continued

| Light-Sensitive Material A | |
|---|---|
| | invention (10 mg/m$^2$) |
| Third Layer (green-sensitive emulsion layer) | Silver iodobromide emulsion (iodide: 10 mol %, silver coverage: 400 mg/m$^2$), Compound*4 (180 mg/m$^2$), Sensitizing Dye (D-1) (1 × 10$^{-6}$ mol/m$^2$), Base precursor*3 (515 mg/m$^2$), Compound (2) according to the present invention (5 mg/m$^2$), Magenta Dye Providing Substance (LI-8) (400 mg/m$^2$), Gelatin (1,000 mg/m$^2$), Solvent having a high boiling point*1 (800 mg/m$^2$), Surface active agent*2 (100 mg/m$^2$), Compound*5 (24 mg/m$^2$) |
| Second Layer (intermediate layer) | Gelatin (1,000 mg/m$^2$), Base precursor*3 (230 mg/m$^2$), Compound (2) according to the present invention (10 mg/m$^2$) |
| First Layer (red-sensitive emulsion layer) | Silver iodobromide emulsion (iodide: 10 mol %, silver coverage: 400 mg/m$^2$), Compound*4 (180 mg/m$^2$), sensitizing Dye (D-2) (8 × 10$^{-7}$ mol/m$^2$), Base precursor*3 (515 mg/m$^2$), Compound (2) according to the present invention (5 mg/m$^2$), |
| Cyan Dye Providing Substance (LI-16) (300 mg/m$^2$), Gelatin (1,000 mg/m$^2$), Solvent having a high boiling point*1 (600 mg/m$^2$), Surface active agent*2 (100 mg/m$^2$), Compound*5 (18 mg/m$^2$) | |

TABLE 1-continued

| Light-Sensitive Material A |
|---|
| Support |

*1 $(isoC_9H_{19}O)_3P{=}O$

*2 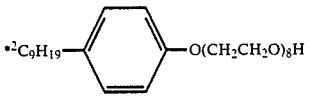

*3 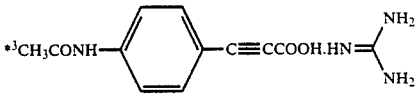

*4 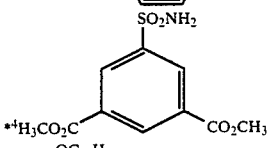

*5 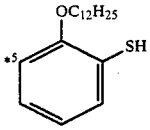

D-1

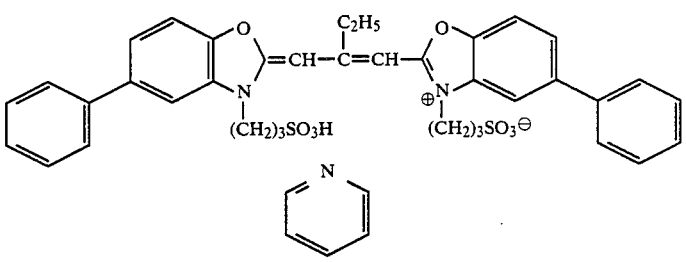

D-2

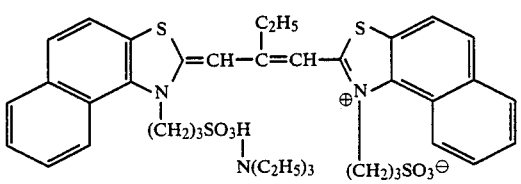

Light-Sensitive Materials B and C were prepared in the same manner as described for Light-Sensitive Material A except using Compounds (7) and (10) according to the present invention in place of Compound (2) according to the present invention, respectively.

Further, for comparison, Light-Sensitive Material D, which did not contain a compound according to the present invention, was prepared in the same manner as described above.

A method for preparing an image receiving material having an image receiving layer is described in the following.

0.75 g of Gelatin Hardener (H-1) described below and 0.25 g of Gelatin Hardener (H-2) described below, 160 ml of water, and 100 g of a 10% aqueous solution of lime-processed gelatin were uniformly mixed.

Gelatin Hardener (H-1)

$CH_2{=}CHSO_2CH_2CONHCH_2CH_2NHCOCH_2.$
$.SO_2CH{=}CH_2$

Gelatin Hardener (H-2)

$CH_2{=}CHSO_2CH_2CONHCH_2CH_2CH_2NHCOCH-$
$_2SO_2CH{=}CH_2$

The resulting mixture solution was uniformly coated on a paper support laminated with polyethylene containing titanium dioxide dispersed therein at a wet layer thickness of 60 μm, and then dried.

15 g of a polymer having the structure shown below was dissolved in 200 ml of water, and then uniformly mixed with 100 g of a 10% aqueous solution of lime-processed gelatin. The resulting mixture solution was uniformly coated at a wet layer thickness of 85 μm on the above-described coating and dried. The thus-prepared material was used as a dye fixing material.

Polymer:

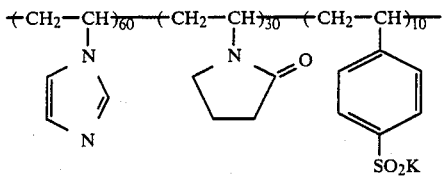

[limiting viscosity measured by a light-scattering method in a 1/20 M $Na_2HPO_4$ aqueous solution at 30° C.: 0.3473]

The above-described multilayer color light-sensitive materials were each exposed through a three color separation filter of B, G and R, the density of which continuously changes for 10 seconds at 2,000 lux using a tungsten lamp and then uniformly heated for 20 seconds or 30 seconds on a heat block heated at 150° C.

The image receiving material was soaked in water and then superimposed on each of the above heated Light-Sensitive Materials A to D in such a manner that their coated layers were in contact with each other.

After heating for 6 seconds on a heated block maintained at 80° C., the image receiving material was separated from the light-sensitive material, whereupon a negative magenta color image was obtained in the image receiving material.

Negative image density was measured by means of a Macbeth reflective densitometer (RD-519). The results thus obtained are shown in Table 2.

TABLE 2

| Light-Sensitive Material | Compound According to the Present Invention | Filter | Heating at 150° C. for 20 Seconds | | Heating at 150° C. for 30 Seconds | |
|---|---|---|---|---|---|---|
| | | | Maximum Density | Minimum Density | Maximum Density | Minimum Density |
| A | (2) | B | 1.90 | 0.16 | 1.93 | 0.20 |
| | | G | 2.03 | 0.18 | 2.05 | 0.21 |
| | | R | 2.12 | 0.17 | 2.16 | 0.22 |
| B | (7) | B | 1.94 | 0.15 | 2.00 | 0.16 |
| | | G | 2.00 | 0.18 | 2.03 | 0.20 |
| | | R | 2.13 | 0.17 | 2.17 | 0.21 |
| C | (10) | B | 1.96 | 0.19 | 2.00 | 0.23 |
| | | G | 2.04 | 0.20 | 2.10 | 0.22 |
| | | R | 2.12 | 0.17 | 2.14 | 0.19 |
| D | — | B | 1.95 | 0.18 | 2.07 | 0.31 |
| (Comparison) | | G | 2.04 | 0.20 | 2.21 | 0.38 |
| | | R | 2.14 | 0.17 | 2.28 | 0.29 |

In Table 2 and hereinafter, B refers to blue, G refers to green, and R refers to red.

It is apparent from the results shown in Table 2 that the increase in the maximum density and minimum density are small even when the developing time is extended 10 seconds in the case of using the compound according to the present invention. On the contrary, in the comparative sample which did not contain the compound according to the present invention, a significant increase of fog was observed. Therefore, it can be understood that the compound according to the present invention has a large effect on stopping development.

EXAMPLE 2

A method for preparing a silver halide emulsion for the fifth layer is described in the following.

To an aqueous solution of gelatin (prepared by dissolving 20 g of gelatin and ammonia in 1,000 ml of water and maintained at 50° C.) was added simultaneously 1,000 ml of an aqueous solution containing potassium iodide and potassium bromide and an aqueous solution of silver nitrate (prepared by dissolving 1 mol of silver nitrate in 1,000 ml of water) while stirring thoroughly and maintaining pAg constant. Thus, a monodispersed silver iodobromide emulsion (iodide content: 5 mol%, crystal form: octahedral, average grain size: 0.5 μm) was prepared.

After washing with water and desalting, 5 mg of chloroauric acid (tetrahydrate) and 2 mg of sodium thiosulfate were added to the emulsion and then it was subjected to gold sensitization and sulfur sensitization at 60° C. The yield of the emulsion was 1.0 kg.

A method for preparing a silver halide emulsion for the third layer is described in the following.

To an aqueous solution of gelatin (prepared by dissolving 20 g of gelatin and 3 g of sodium chloride in 1,000 ml of water and maintained at 75° C.) were added simultaneously dropwise 600 ml of an aqueous solution containing sodium chloride and potassium bromide, an aqueous solution of silver nitrate (prepared by dissolving 0.59 mol of silver nitrate in 600 ml of water) and Dye Solution (I) described below over 40 minutes at an equal addition amount rate while stirring thoroughly. Thus, a monodispersed silver chlorobromide emulsion (bromide content: 80 mol%, crystal form: cubic, average grain size: 0.35 μm) absorbed with sensitizing dye was prepared.

After washing with water and desalting, 5 mg of sodium thiosulfate and 20 mg of 4-hydroxy-6-methyl-1,3,3a,7-tetraazaindene were added and then it was subjected to chemical sensitization at 60° C. The yield of the emulsion was 600 g.

| Dye Solution (I) | |
|---|---|
| 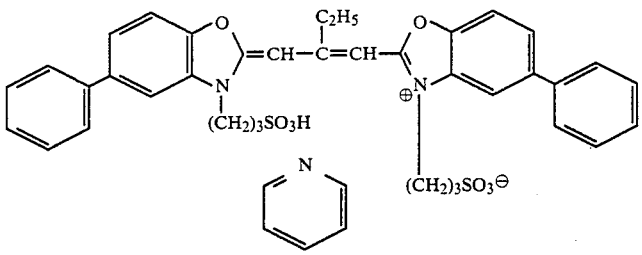 | 160 mg |
| Methanol | 400 ml |

A method for preparing a silver halide emulsion for the first layer is described in the following.

To an aqueous solution of gelatin (prepared by dissolving 20 g of gelatin and 3 g of sodium chloride in 1,000 of water and maintained at 75° C.) were added dropwise 600 ml of an aqueous solution containing sodium chloride and potassium bromide and an aqueous solution of silver nitrate (prepared by dissolving 0.59 mol of silver nitrate in 600 ml of water) over 40 minutes at an equal addition amount rate while stirring thoroughly. Thus, a monodispersed silver chlorobromide emulsion (bromide content: 80 mol%, crystal from: cubic, average grain size: 0.35 μm) absorbed with sensitizing dye was prepared.

After washing with water and desalting, 5 mg of sodium thiosulfate and 20 mg of 4-hydroxy-6-methyl-1,3,3a,7-tetraazaindene were added and then it was subjected to chemical sensitization at 60° C. The yield of the emulsion was 600 g.

The silver benzotriazole emulsion was prepared in the same manner as described in Example 1.

A color light-sensitive material having the multilayer structure shown in Table 3 below was prepared using the above-described components. This material was designated Light-Sensitive Material E. In Table 3 below numerals in parentheses indicate coating amounts.

TABLE 3

| Light-Sensitive Material E | |
|---|---|
| Sixth Layer | Gelatin (740 mg/m$^2$),<br>Base Precursor (A)*3 (250 mg/m$^2$) |
| Fifth Layer (blue-sensitive emulsion layer) | Silver iodobromide emulsion (iodide: 5 mol %, silver coverage: 500 mg/m$^2$),<br>Benzenesulfonamide (160 mg/m$^2$),<br>Base Precursor (A)*3 (270 mg/m$^2$),<br>Silver benzotriazole emulsion (silver coverage: 300 mg/m$^2$),<br>Yellow Dye Providing Substance (LI-4) (400 mg/m$^2$),<br>Gelatin (1,200 mg/m$^2$),<br>Solvent having a high boiling point*1 (700 mg/m$^2$),<br>Surface active agent*2 (70 mg/m$^2$) |
| Fourth Layer (intermediate layer) | Gelatin (700 mg/m$^2$),<br>Base Precursor (A)*3 (240 mg/m$^2$) |
| Third Layer (green-sensitive emulsion layer) | Silver chlorobromide emulsion (bromide: 80 mol %, silver coverage: 200 mg/m$^2$),<br>Benzenesulfonamide (140 mg/m$^2$),<br>Silver benzotriazole emulsion (silver coverage: 100 mg/m$^2$),<br>Base Precursor (A)*3 (210 mg/m$^2$),<br>Magenta Dye Providing Substance (LI-8) (330 mg/m$^2$),<br>Gelatin (860 mg/m$^2$),<br>Solvent having a high boiling point*1 |

TABLE 3-continued

| Light-Sensitive Material E | |
|---|---|
| | (430 mg/m$^2$),<br>Surface active agent*2 (60 mg/m$^2$) |
| Second Layer (intermediate layer) | Gelatin (1,000 mg/m$^2$),<br>Base Precursor (A)*3 (240 mg/m$^2$) |
| First Layer (red-sensitive emulsion layer) | Silver chlorobromide emulsion (bromide: 80 mol %, silver coverage: 200 mg/m$^2$),<br>Benzenesulfonamide (140 mg/m$^2$),<br>Sensitizing dye*4 (8 × 10$^{-7}$ mol/m$^2$),<br>Silver benzotriazole emulsion (230 mg/m$^2$),<br>Base Precursor (A)*3 (230 mg/m$^2$),<br>Cyan Dye Providing Substance (LI-16) (300 mg/m$^2$),<br>Gelatin (850 mg/m$^2$),<br>Solvent having a high boiling point*1 (540 mg/m$^2$),<br>Surface active agent*2 (60 mg/m$^2$) |
| Support | |

*1 $(iso C_9H_{19}O)_3P{=}O$

*2 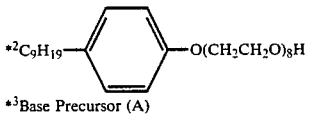

*3 Base Precursor (A)

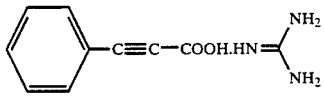

*4 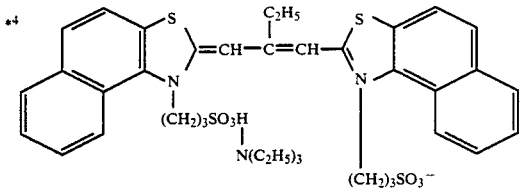

A method for preparing a dye fixing material is described in the following.

12 g of lime-processed gelatin was dissolved in 200 ml of water, to the solution was added 16 ml of a 0.5M aqueous solution of zinc acetate and uniformly mixed. The resulting mixture solution was uniformly coated on a white film support having a thickness of 100 μm composed of polyethylene terephthalate containing titanium dioxide at a wet layer thickness of 85 μm. Then, on the layer, a coating solution having the composition shown below was uniformly coated at a wet layer thickness of 90 μm and dried to prepare a dye fixing material.

| Coating Solution Composition for Dye Fixing Layer F | |
|---|---|
| 10% Aqueous solution of polyvinyl alcohol (degree of polymerization: 2,000) | 120 g |

-continued

| | |
|---|---|
| Urea | 20 g |
| N—Methylurea | 20 g |
| 12% Aqueous solution of the formula: | 80 g |

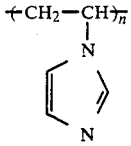

(limiting viscosity measured in a 1% NaCl aqueous solution at 30° C.: 0.1726)

| | |
|---|---|
| Gelatin dispersion of Compound (2) according to the present invention (the same as described in Example 1) | 60 ml |

Coating Solution Composition for Dye Fixing Layer G

| | |
|---|---|
| 10% Aqueous solution of polyvinyl alcohol (degree of polymerization: 2,000) | 120 g |
| Urea | 20 g |
| N—Methylurea | 20 g |
| 12% Aqueous solution of the formula: | 80 g |

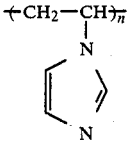

(the same polymer as used in Dye Fixing Layer F)

| | |
|---|---|
| Water | 60 ml |

The above-described multilayer color light-sensitive material was exposed through a three color separation filter of B, G and R the density of which continuously changes for 1 second at 2,000 lux using a tungsten lamp and then uniformly heated for 20 seconds on a heat block heated at 150° C.

The heated light-sensitive material was superimposed on each of the dye fixing materials described above in such a manner that their coated layers were in contact with each other, passed between pressed heat rollers at 130° C. and immediately thereafter heated at 120° C. for 30 seconds on a heated block. After the heating, the dye fixing material was separated from the light-sensitive material, whereupon yellow, magenta and cyan color images corresponding to the B, G and R three color separation filter were obtained in the dye fixing material.

The maximum density and the minimum density of each color were measured using a Macbeth reflective densitometer (RD-519). The results thus obtained are shown in Table 4.

TABLE 4

| Color Separation Filter | Dye Fixing Layer F (Present Invention) Maximum Density | Dye Fixing Layer F (Present Invention) Minimum Density | Dye Fixing Layer G (Comparison) Maximum Density | Dye Fixing Layer G (Comparison) Minimum Density |
|---|---|---|---|---|
| B | 1.86 | 0.18 | 1.90 | 0.28 |
| G | 2.11 | 0.20 | 2.12 | 0.32 |
| R | 2.21 | 0.19 | 2.25 | 0.29 |

It is apparent from the results shown in Table 4 that an increase of fog during the transfer step is effectively restrained when the compound according to the present invention is added to the dye fixing layer.

EXAMPLE 3

A mixture of 10 g of Dye Providing Substance (LI-17) described below, 0.5 g of succinic acid 2-ethylhexyl ester sulfonic acid sodium salt, 10 g of tricresyl phosphate and 20 ml of cyclohexanone was dissolved by heating at 60° C. to prepare a uniform solution. The solution was mixed with 100 g of a 10% aqueous solution of lime-processed gelatin with stirring and the mixture was dispersed by means of a homogenizer to prepare a dispersion of dye providing substance.

Dye Providing Substance (LI-17):

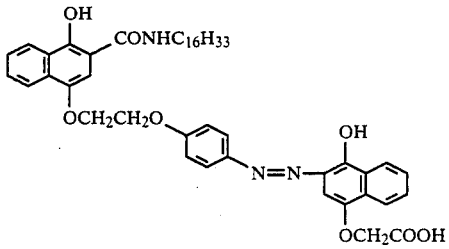

Light-Sensitive Material H was prepared in the following manner.

| | | |
|---|---|---|
| (a) | Silver iodobromide emulsion (the same as described in Example 1) | 5.5 g |
| (b) | 10% Aqueous solution of gelatin | 0.5 g |
| (c) | Dispersion of Dye Providing Substance (LI-17) (described above) | 2.5 g |
| (d) | 10% Ethanol solution of guanidine trichloroacetate | 1 ml |
| (e) | 10% Methanol solution of 2,6-dichloro-4-aminophenol | 0.5 ml |
| (f) | 5% Aqueous solution of a compound having the following formula: | 1 ml |

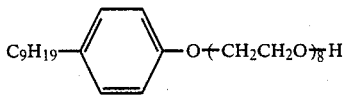

| | | |
|---|---|---|
| (g) | Gelatin dispersion of Compound (2) according to the present invention (the same as described in Example 1) | 0.5 ml |
| (h) | Water | 6 ml |

The above components (a) to (h) were mixed and dissolved by heating and the mixture was coated on a polyethylene terephthalate film at a wet layer thickness of 85 μm and dried. On the thus-formed layer, a protecting layer containing 1.5 g/m$^2$ of gelatin was provided and dried, whereby Light-Sensitive Material H was prepared.

Light-Sensitive Material H thus obtained was imagewise exposed for 10 seconds at 2,000 lux using a tungsten lamp and then uniformly heated for 30 seconds or 40 seconds on a heat block heated at 140° C.

Thereafter the material was processed in the same manner as described in Example 1 and the results shown in Table 5 were obtained.

TABLE 5

| Light-Sensitive Material | Heating at 140° C. for 30 Seconds | | Heating at 140° C. for 40 Seconds | |
|---|---|---|---|---|
| | Maximum Density | Minimum Density | Maximum Density | Minimum Density |
| H | 2.02 | 0.18 | 2.06 | 0.20 |

From the results shown in Table 5 it can be recognized that the compound according to the present invention also exhibits the remarkable effects of the present invention in a light-sensitive material containing a dye providing substance which releases a dye by a coupling reaction with the oxidation product of a developing agent.

EXAMPLE 4

A mixture of 5 g of Dye Providing Substance LI-18) having the structure shown below, 4 g of an electron donor having the structure shown below, 0.5 g of succinic acid 2-ethylhexyl ester sulfonic acid sodium salt, 10 g of tricresyl phosphate and 20 ml of cyclohexanone was dissolved by heating at about 60° C. Then, the same procedure as described in Example 3 was carried out to prepare a dispersion of dye providing substance capable of being reduced.

Dye Providing Substance (LI-18):

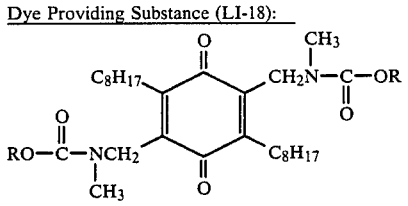

wherein R represents:

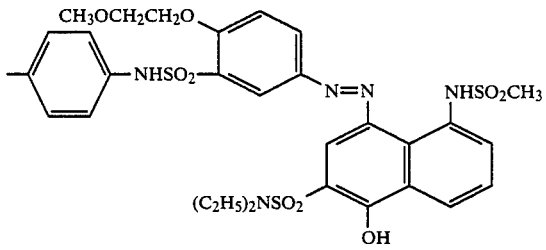

Electron Donor:

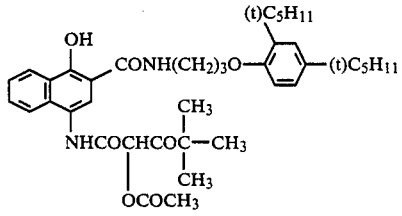

Light-Sensitive Material I was prepared in the same manner as described for Light-Sensitive Material H in Example 3, except using the above-described dispersion of dye providing substance capable of being reduced in place of a dispersion of Dye Providing Substance (LI-17).

Light-Sensitive Material I thus obtained was subjected to light exposure and processing in the same manner as described in Example 3 and the results shown in Table 6 were obtained.

TABLE 6

| Light-Sensitive Material | Heating at 140° C. for 30 Seconds | | Heating at 140° C. for 40 Seconds | |
|---|---|---|---|---|
| | Maximum Density | Minimum Density | Maximum Density | Minimum Density |
| I | 1.75 | 0.18 | 1.79 | 0.20 |

From the results shown in Table 6 it can be recognized that the compound according to the present invention also exhibits good effect in a light-sensitive material containing a dye providing substance which is capable of being reduced and providing a positive image with respect to a silver image.

EXAMPLE 5

A method for preparing a gelatin dispersion of a coupler is described in the following.

A mixture of 5 g of 2-dodecylcarbamoyl-1-naphthol, 0.5 g of succinic acid 2-ethylhexyl ester sulfonic acid sodium salt, 2.5 g of tricresyl phosphate (TCP) and 30 ml of ethyl acetate was dissolved. The solution was mixed with 100 g of a 10% aqueous solution of gelatin with stirring and the mixture was dispersed by means of a homogenizer at 10,000 rpm for 10 minutes.

Light-Sensitive Material J was prepared in the following manner.

| | | |
|---|---|---|
| (a) | Silver iodobromide emulsion (the same as described in Example 1) | 10 g |
| (b) | Gelatin dispersion of coupler (described above) | 3.5 g |
| (c) | Solution containing 0.25 g of guanidine trichloroacetate dissolved in 2.5 ml of ethanol | |
| (d) | 10% Aqueous solution of gelatin | 5 g |
| (e) | Solution containing 0.2 g of 2,6-dichloro-p-aminophenol dissolved in 15 ml of water | 0.2 g |
| (f) | Gelatin dispersion of Compound (2) according to the present invention (the same as described in Example 1) | 1 ml |

A coating solution having the composition shown above was coated on a polyethylene terephthalate film support at a wet layer thickness of 60 μm and dried, whereby Light-Sensitive Material J was prepared.

Light-Sensitive Material J thus obtained was imagewise exposed for 5 seconds at 2,000 lux using a tungsten lamp and then uniformly heated for 20 seconds or 30 seconds on a heated block heated at 150° C., whereby a negative cyan color image was obtained.

Negative image density was measured by means of a Macbeth transmission densitometer (TD-504). The results thus obtained are shown in Table 7.

TABLE 7

| Light-Sensitive Material | Heating at 150° C. for 20 Seconds | | Heating at 150° C. for 30 Seconds | |
|---|---|---|---|---|
| | Maximum Density | Minimum Density | Maximum Density | Minimum Density |
| J | 2.08 | 0.17 | 2.12 | 0.19 |

From the results shown in Table 7 it can be understood that the compound according to the present invention exhibits a large effect on stopping development.

EXAMPLE 6

In this example, a black-and-white system is illustrated.

Light-Sensitive Material K was prepared in the following manner.

| | | |
|---|---|---|
| (a) | Silver iodobromide emulsion (the same as described in Example 1) | 1 g |
| (b) | Silver benzotriazole emulsion (the same as described in Example 1) | 10 g |
| (c) | 10% Ethanol solution of guanidine trichloroacetate | 1 ml |
| (d) | 5% Methanol solution of a compound having the following formula: 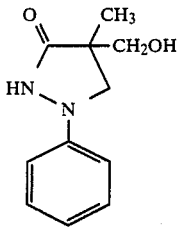 | 2 ml |
| (e) | Gelatin dispersion of Compound (2) according to the present invention (the same as described in Example 1) | 1 ml |

A coating solution having the composition shown above was coated on a polyethylene terephthalate film support at a wet layer thickness of 60 μm and dried, whereby Light-Sensitive Material K was prepared.

Light-Sensitive Material K thus obtained was imagewise exposed for 5 seconds at 2,000 lux using a tungsten lamp and then uniformly heated for 30 seconds or 40 seconds on a heated block heated at 130° C., whereby a negative brown image was obtained.

Negative image density was measured by means of a Macbeth transmission densitometer (TD-504). The results thus obtained are shown in Table 8.

TABLE 8

| Light-Sensitive Material | Heating at 130° C. for 30 Seconds | | Heating at 130° C. for 40 Seconds | |
|---|---|---|---|---|
| | Maximum Density | Minimum Density | Maximum Density | Minimum Density |
| K | 0.81 | 0.13 | 0.84 | 0.15 |

From the results shown in Table 8 it can be understood that the compound according to the present invention exhibited the large effect on stopping development.

While the invention has been described in detail and with reference to specific embodiments thereof, it will be apparent to one skilled in the art that various changes and modifications can be made therein without departing from the spirit and scope thereof.

What is claimed is:

1. A method for forming an image, which comprises exposing a silver halide containing light-sensitive material imagewise to light and heating said light-sensitive material in the presence of a compound capable of forming a 2-mercaptobenzazole ring by a ring closing reaction when heated, wherein the compound capable of forming a 2-mercaptobenzazole ring is represented by formula (I), (II), or (III)

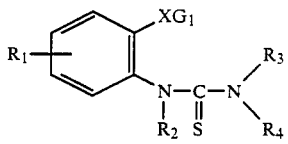

(I)

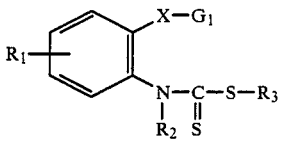

(II)

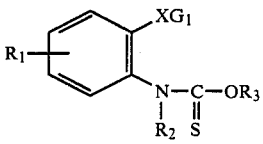

(III)

wherein X represents an oxygen atom, a sulfur atom or a group represented by

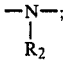

$G_1$ represents a hydrogen atom or a protective group capable of being removed upon action of a nucleophilic reagent; $R_1$ represents a hydrogen atom, a halogen atom, a substituted or unsubstituted alkyl group having from 1 to 12 carbon atoms, a substituted or unsubstituted cycloalkyl group having from 5 to 10 carbon atoms, a substituted or unsubstituted alkenyl group having from 2 to 12 carbon atoms, a substituted or unsubstituted aryl group having from 6 to 14 carbon atoms, a substituted or unsubstituted aralkyl group having from 7 to 14 carbon atoms, a substituted or unsubstituted alkoxy group having from 1 to 12 carbon atoms, a substituted or unsubstituted aryloxy group, a cyano group, a nitro group, a sulfo group, a carboxy group, an alkylsulfonyl group, an arylsulfonyl group, a substituted or unsubstituted sulfamoyl group, a substituted or unsubstituted carbamoyl group, a substituted or unsubstituted amino group, an alkylacylamino group, an arylacylamino group, an alkylsulfonylamino group, or an arylsulfonylamino group, or two or more of $R_1$ groups are present and in such a case the $R_1$ groups are the same or different or the $R_1$ groups are connected to form a condensed carbocyclic or heterocyclic ring; $R_2$, $R_3$ and $R_4$ each represents a hydrogen atom, a substituted or unsubstituted alkyl group having from 1 to 8 carbon atoms, a substituted or unsubstituted aralkyl group having from 7 to 14 carbon atoms, or a substituted or unsubstituted aryl group having from 6 to 14 carbon atoms; and M represents a metallic atom or a primary, secondary, tertiary or quaternary ammonium group.

2. A method for forming an image as in claim 1, wherein when the $R_1$ groups are connected to form a condensed carbocyclic ring, said carbocyclic ring formed is a naphthalene ring, a methylenedioxybenzene ring, a tetrahydronaphthalene ring, an indole ring, or a benzofuran ring.

3. A method for forming an image as in claim 1, wherein when the $R_1$ groups are connected to form a condensed heterocyclic ring, said heterocyclic ring formed is a pyridine ring, a pyrimidine ring, or a quinoline ring.

4. A method for forming an image as in claim 1, wherein the compound capable of forming a mercaptobenzazole ring is present in the light-sensitive material.

5. A method for forming an image as in claim 4, wherein the amount of the compound capable of forming a mercaptobenzazole ring is about 0.01 to 50 wt% based on the total weight of coating layers of the light-sensitive material.

6. A method for forming an image as in claim 1, wherein said light-sensitive material contains one or more dye providing compounds which form or release imagewise diffusible dyes from a light-sensitive layer and the compound capable of forming a mercaptobenzazole ring is present in a dye fixing material.

7. A method for forming an image as in claim 6, wherein the amount of the compound capable of forming a mercaptobenzazole ring is about 0.01 to 50 wt% based on the total weight of coating layers of the dye fixing material.

8. A method for forming an image as in claim 4, wherein the light-sensitive material contains a light-sensitive silver halide emulsion.

9. A method for forming an image as in claim 8, wherein the light-sensitive material further contains an organic silver salt oxidizing agent.

10. A method for forming an image as in claim 8, wherein the silver halide is spectrally sensitized with a sensitizing dye.

11. A method for forming an image as in claim 8, wherein the light-sensitive material further contains a dye providing substance.

12. A method for forming an image as in claim 11, wherein the dye providing substance is a coupler capable of reacting with a developing agent.

13. A method for forming an image as in claim 11, wherein the dye providing substance is represented by formula (LI)

$$(\text{Dye—X})_n\text{—Y} \qquad \text{(LI)}$$

wherein Dye represents a dye moiety or a dye precursor moiety; X represents a simple bond or a connecting group; Y represents a group having a property such that diffusibility of the compound represented by $(\text{Dye—X})_n$—Y can be differentiated in correspondence or countercorrespondence to light-sensitive silver salts having a latent image distributed imagewise, or a group having a property of releasing Dye in correspondence or countercorrespondence to light-sensitive silver salts having a latent image distributed imagewise, with the diffusibility of Dye released being different from that of the compound represented by $(\text{Dye—X})_n$—Y; and n represents 1 or 2 and when n is 2, the two Dye—X groups are the same or different.

14. A method for forming an image as in claim 8, wherein the light-sensitive material further contains a reducing substance.

15. A method for forming an image as in claim 8, wherein the light-sensitive material further contains a development stopping agent.

16. A method for forming an image as in claim 6, wherein the dye fixing material further contains a polymer mordant.

* * * * *